US007050725B2

(12) United States Patent
Jingu

(10) Patent No.: US 7,050,725 B2
(45) Date of Patent: May 23, 2006

(54) IMAGE FORMING APPARATUS EMPLOYING TWO PRINTING METHODS

(75) Inventor: Hidehito Jingu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/790,041

(22) Filed: Mar. 2, 2004

(65) Prior Publication Data

US 2004/0175191 A1 Sep. 9, 2004

(30) Foreign Application Priority Data

Mar. 3, 2003 (JP) ..... 2003-055192

(51) Int. Cl.
*G03G 15/00* (2006.01)

(52) U.S. Cl. ..... 399/2; 399/6

(58) Field of Classification Search ..... 399/2, 399/6, 7

See application file for complete search history.

(56) References Cited

U.S. PATENT DOCUMENTS 5,323,221 A * 6/1994 Tomimori et al. ..... 399/2
5,373,350 A * 12/1994 Taylor et al. ..... 399/2
5,563,694 A * 10/1996 Katayama ..... 399/2
5,729,785 A * 3/1998 Sakaizawa et al. ..... 399/2
5,781,823 A * 7/1998 Isobe et al. ..... 399/2
6,725,770 B1 * 4/2004 Maeda ..... 101/129

FOREIGN PATENT DOCUMENTS

JP 09-169474 6/1997

* cited by examiner

*Primary Examiner*—Louis Arana
(74) *Attorney, Agent, or Firm*—Rabin & Berdo, PC

(57) ABSTRACT

An image forming apparatus has a first image forming unit and a second image forming unit that form images by different methods on the same page. The image formed by the second image forming unit is used as an identifying image to distinguish an original document made by the image forming apparatus from copies of the original document. The second image forming unit may, for example, emboss or punch holes in the printing medium. The second image forming unit may accordingly be a serial impact dot matrix printing unit or a stamping unit, while the first printing unit may be, for example, an ink jet printing unit or an electrophotographic printing unit. One of the two image forming units is preferably capable of making copies by printing on multiple-ply forms.

24 Claims, 37 Drawing Sheets

| PRINTING UNIT (1) | PRINTING POSITION (2) | IMAGE INFORMATION (3) |
|---|---|---|

| | | |
|---|---|---|
| 1 | X=50,Y=50 | 'A' |

| | | |
|---|---|---|
| 2 | X=100,Y=100 | 'B' |

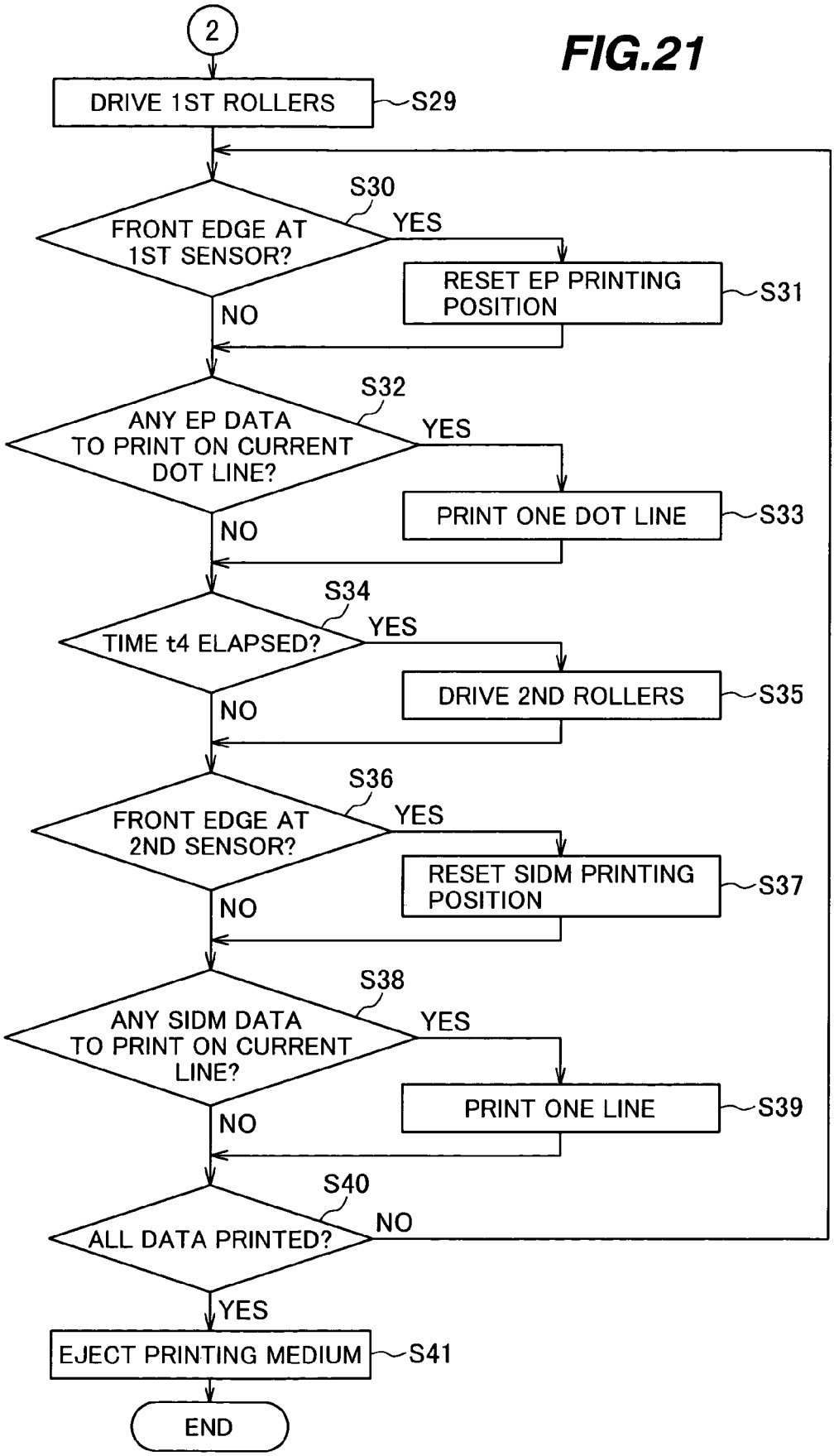
2
FIG.21
DRIVE 1ST ROLLERS
S29
S30
FRONT EDGE AT 1ST SENSOR?
YES
RESET EP PRINTING POSITION
S31
NO
S32
ANY EP DATA TO PRINT ON CURRENT DOT LINE?
YES
PRINT ONE DOT LINE
S33
NO
S34
TIME t4 ELAPSED?
YES
DRIVE 2ND ROLLERS
S35
NO
S36
FRONT EDGE AT 2ND SENSOR?
YES
RESET SIDM PRINTING POSITION
S37
NO
S38
ANY SIDM DATA TO PRINT ON CURRENT LINE?
YES
PRINT ONE LINE
S39
NO
S40
ALL DATA PRINTED?
NO
YES
EJECT PRINTING MEDIUM
S41
END

IMAGE FORMING APPARATUS EMPLOYING TWO PRINTING METHODS

BACKGROUND OF THE INVENTION

1. Field of the Invention

The present invention relates to image forming apparatus such as printing apparatus.

2. Description of the Related Art

Several different image forming methods or printing methods are used by commercially available image forming apparatus. Ordinarily, the user selects and uses an apparatus employing a printing method that suits the use to which the apparatus will be put, as noted in Japanese Unexamined Patent Application Publication No. 9-169474.

Electrophotographic image forming apparatus such as laser printers and light-emitting-diode (LED) printers, referred to below as electrophotographic printers, forms a latent image by illuminating the surface of a photosensitive drum, develops the latent image by applying toner, and transfers the toner image from the photosensitive drum to paper or other printing media. Since electrophotographic printers can print at high speed with high quality, they are widely used in business work.

Serial impact dot matrix printers have an impact mechanism with needle pins that strike an inked ribbon, thereby transferring ink from the ribbon to the printing media and forming an image made up of dots. The advantage of a serial impact dot matrix printer is that it can make copies, as the force of the impact is also transmitted to the lower layers of multiple-ply printing media. Disadvantages of serial impact dot matrix printers include slow speed, inferior printing quality, and noisy operation. Serial impact dot matrix printers are now used mainly for office work that requires the making of copies.

Ink jet printers have a printing head with nozzles from which drops of ink are ejected, each ejected drop forming a dot on the printing medium. Ink jet printers can be classified as piezoelectric or thermal, depending on the method by which the drops are ejected. As both types are comparatively quiet and inexpensive, ink jet printers have become very popular for personal use.

Thermal printers have a thermal head with heating elements that heat an inked ribbon, thereby transferring ink from the ribbon to the printing media. A ribbon of the film type is normally employed. An advantage of thermal printers is their very high resolution, resulting in sharp printed images.

A problem with conventional image forming apparatus is that each apparatus employs only a single printing method. Accordingly, there is no single apparatus that combines, say, a multiple-ply copy-making capability with the speed and quality of electrophotographic printing. When copies of an electrophotographically printed document are required, it is necessary either to print the document again or to use a separate copying machine.

Printing the document again takes time, however, and since it is impossible to distinguish between the original document and the printed copy, various problems tend to arise, especially in an office in which the document and copy are handled by more than one person. Typical problems include treating both documents as copies, so that the original document fails to be delivered to its intended destination; treating both documents as originals, so that the same document is delivered twice to the same destination; failing to make a necessary copy; making unnecessary copies; and losing track of copies, which may then fall into unintended hands. The same problems arise if a copying machine is used, because copying machines are also electrophotographic, making it difficult to tell a copy from the original document. Similar problems arise when a document printed by an ink jet printer is copied.

SUMMARY OF THE INVENTION

An object of the present invention is to provide an image forming apparatus that can form images by a plurality of printing methods and can print documents that, when copied, are distinguishable from the copies.

The invented image forming apparatus has a first image forming unit and a second image forming unit. The first and second image forming units form images by different methods on a single page. The second image forming unit forms an identifying image; the first image forming unit forms an image different from the identifying image. The identifying image preferably identifies the page as an original document page, enabling the original document page to be distinguished from copies thereof. For example, the second image forming unit may have an impact mechanism that deforms or punches holes in the page, thus producing an identifying image that cannot be faithfully copied by a copying machine.

Either the first or the second image forming unit is preferably capable of forming images on the multiple sheets of multiple-ply media.

The first image forming unit may be, for example, an ink jet printing unit or an electrophotographic printing unit. The second image forming unit may be, for example, a serial impact dot matrix printing unit or a stamping or marking unit that forms a fixed mark.

BRIEF DESCRIPTION OF THE DRAWINGS

In the attached drawings:

FIGS. 20 and 21 constitute a flowchart illustrating the operation of the image forming apparatus in the second embodiment;

DETAILED DESCRIPTION OF THE INVENTION

Figure 1:
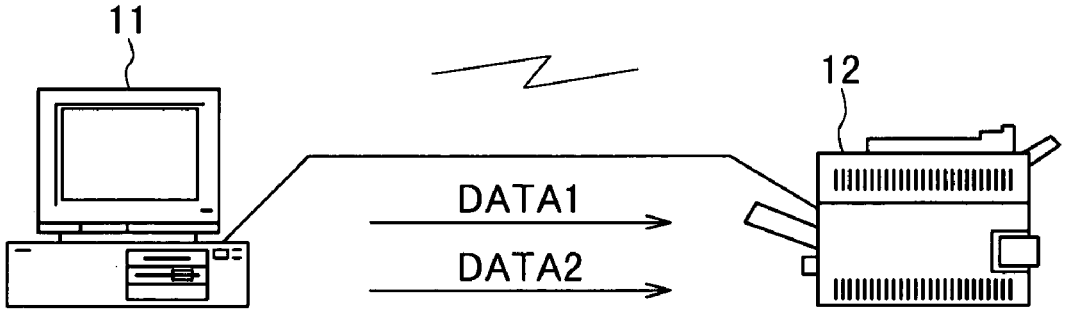
FIG. 1 illustrates communication between an image forming apparatus and a host device in the described embodiments of the invention.

Embodiments of the invention will now be described with reference to the attached drawings, in which like elements are indicated by like reference characters.

The word 'print', as used herein, includes not only printing with ink or toner but also printing methods that deform the printing media by, for example, punching holes or forming an embossed pattern.

Referring to FIG. 1, in a first embodiment of the invention, print data are generated in a host apparatus 11 and sent to an image forming apparatus 12, which prints an image according to the received data. The print data include two types of data, shown as DATA1 and DATA2. The host apparatus 11 is a computing device such as a personal computer, server, or workstation including a processing unit such as a central processing unit (CPU) or microprocessor unit (MPU), memory devices such as a magnetic disk memory and semiconductor memory, a display such as a cathode ray tube (CRT) or liquid crystal display, input means such as a keyboard, and a communication interface. Any type of computing device may be used as the image forming apparatus 12. The image forming apparatus 12 may be connected to a plurality of host apparatuses 11, but it will be assumed below that there is only one host apparatus 11. The image forming apparatus 12 thus receives print data from a single source and prints according to the received data, but some of the print data may also be stored internally in the image forming apparatus 12. Communication between the host apparatus 11 and the image forming apparatus 12 takes place through a printer cable or a wired or wireless communication network, such as a local area network (LAN), wide area network (WAN), intranet, or the Internet. Any type of communication network may be used, and a plurality of communication networks may be combined.

Figure 2:
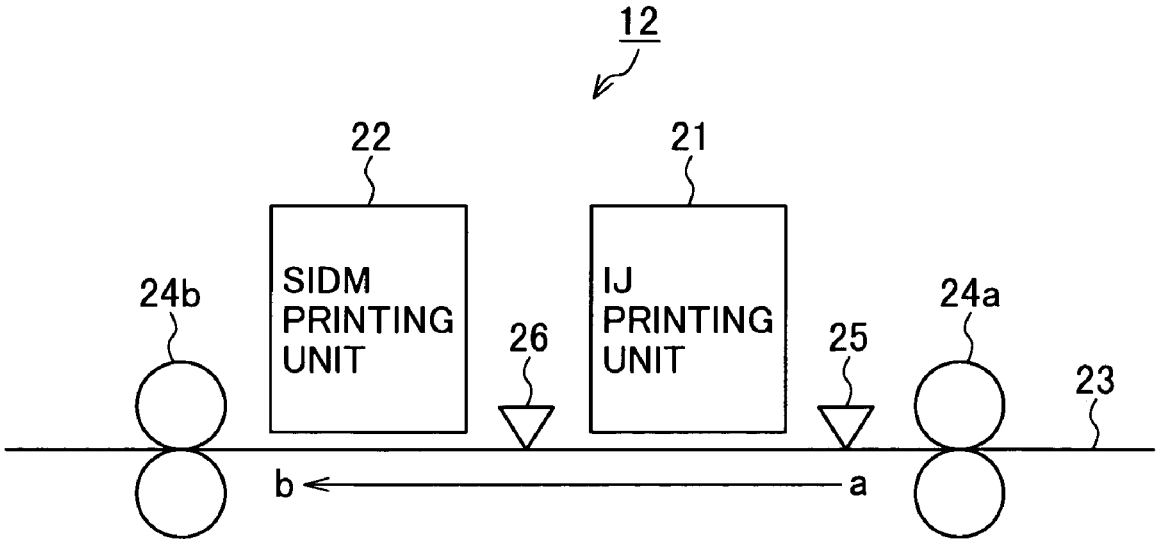
FIG. 2 shows the general arrangement of the image forming part of the image forming apparatus in a first embodiment.

Referring to FIG. 2, the image forming apparatus 12 comprises an ink jet (IJ) printing mechanism 21, which is provided as a first image forming unit, a serial impact dot matrix (SIDM) printing mechanism 22, which is provided as a second image forming unit, a pair of rollers 24*a*, 24*b*, and a pair of sensors 25, 26.

The ink jet printing unit 21 has the same mechanism as an ink jet printer, and the serial impact dot matrix printing unit 22 has the same mechanism as a serial impact dot matrix printer. The sensors 25, 26 detect the position of paper or other printing media 23. The rollers 24*a* and 24*b* transport the printing media 23 on the basis of the positions detected by the sensors 25, 26 in the direction shown by the arrow from 'a' to 'b'.

When the printing medium 23 reaches an appropriate position, the ink jet printing unit 21 prints an image on the printing medium 23 according to the first print data (DATA1) received from the host apparatus 11. When the printing medium 23 reaches a further appropriate position, the serial impact dot matrix printing unit 22 prints an image on the printing medium 23 according to the second print data (DATA2) received from the host apparatus 11. The images printed according to DATA1 and DATA2 are thus both printed on a single page.

Figure 3:
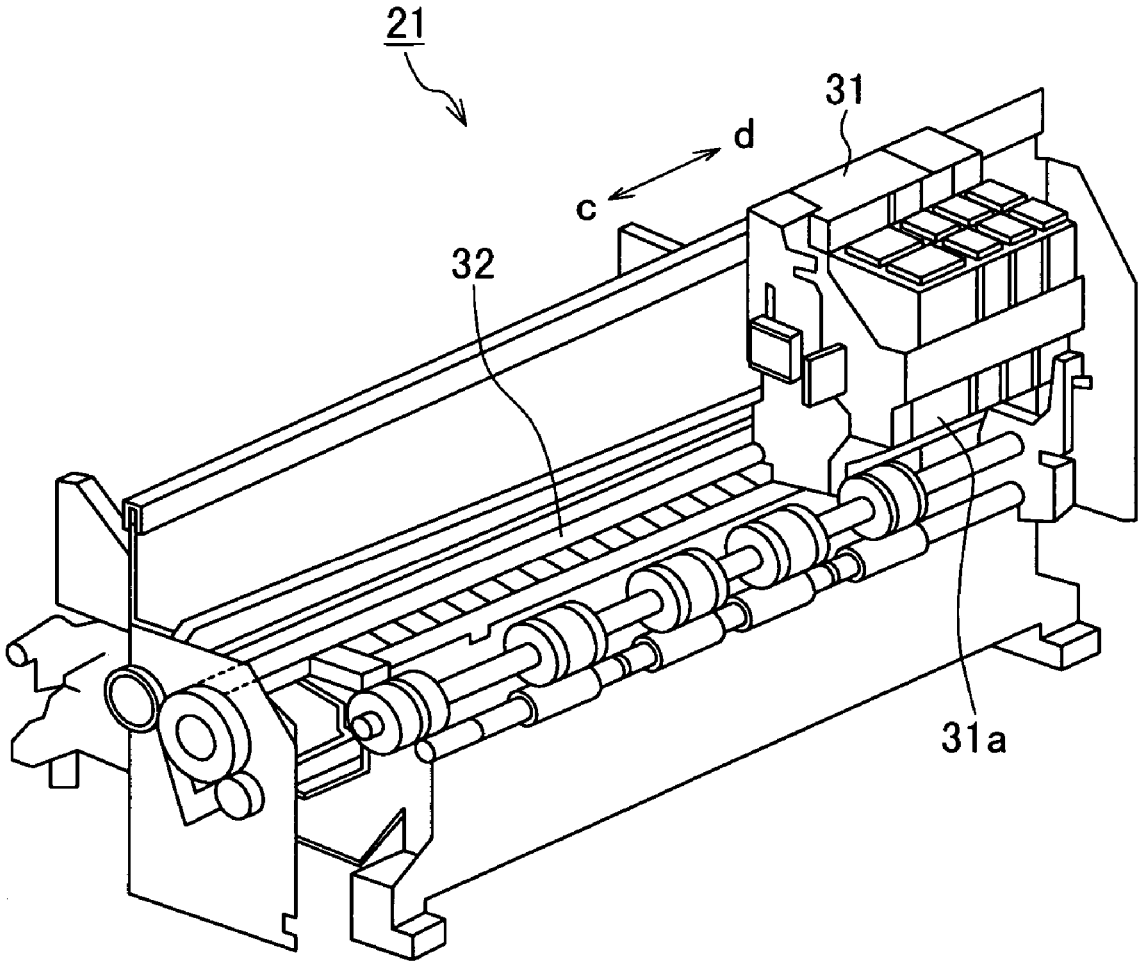
FIG. 3 is a perspective view of the ink jet printing unit in the first embodiment.

The structure of the ink jet printing unit 21 will now be described with reference to FIG. 3. The ink jet printing unit 21 comprises a carriage shaft 32 and a carriage 31, which has ink tanks 31*a* containing different colors of ink and a printing head. The printing head is disposed at the bottom of the carriage 31 and is not visible in the drawing. The carriage 31 is mounted on the carriage shaft 32 in such a manner that the carriage 31 can travel in the longitudinal direction of the carriage shaft 32, as indicated by the double-headed arrow between 'c' and 'd'. Printing takes place as the carriage 31 travels in both directions.

Figure 4:
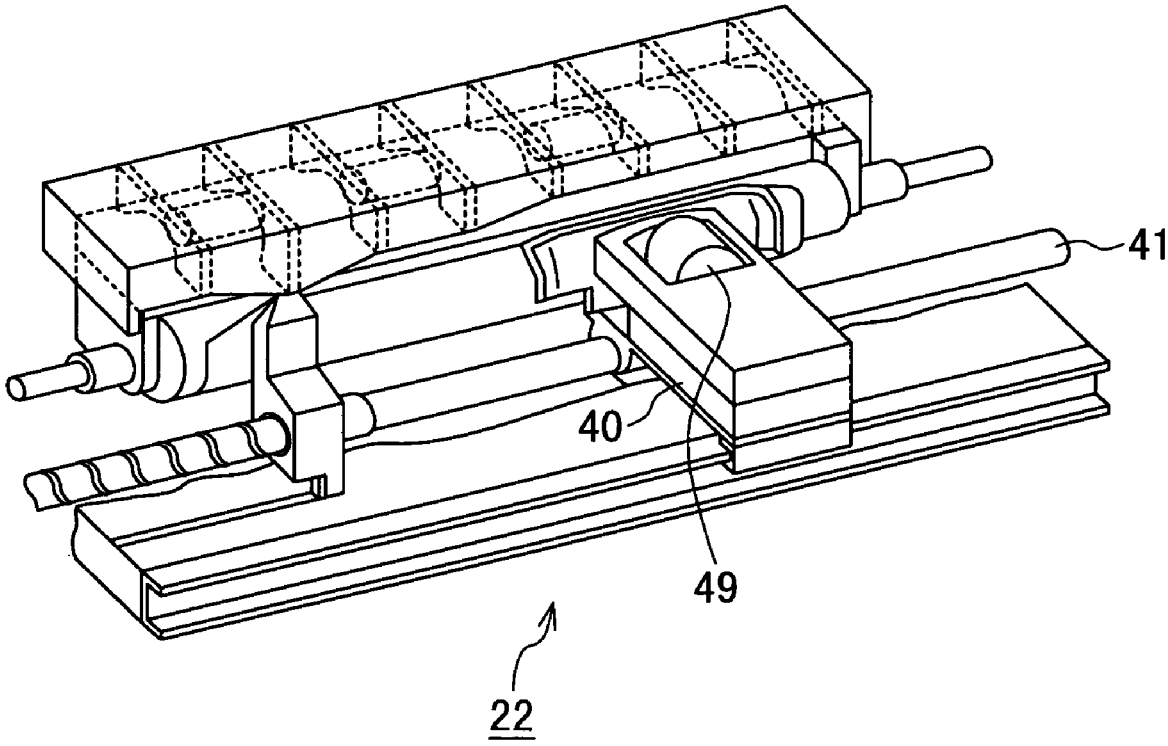
FIG. 4 is a perspective view of the serial impact dot matrix printing unit in the first embodiment.

The structure of the serial impact dot matrix printing unit 22 will be described with reference to FIG. 4. The serial impact dot matrix printing unit 22 comprises a carriage 40 slidably mounted on a carriage shaft 41. A printing head 49 is mounted on the carriage 40. A motor (not shown) drives the carriage 40 back and forth along the carriage shaft 41. The printing head 49 prints on the printing medium (not shown) as the carriage 40 travels in both directions. The printing mechanism in the printing head 49 is an impact mechanism that physically deforms the printing medium 23 while printing, so that the printed image formed on the front side of the printing medium 23 is matched by an embossed image formed on the reverse side of the printing medium 23.

Figure 5:
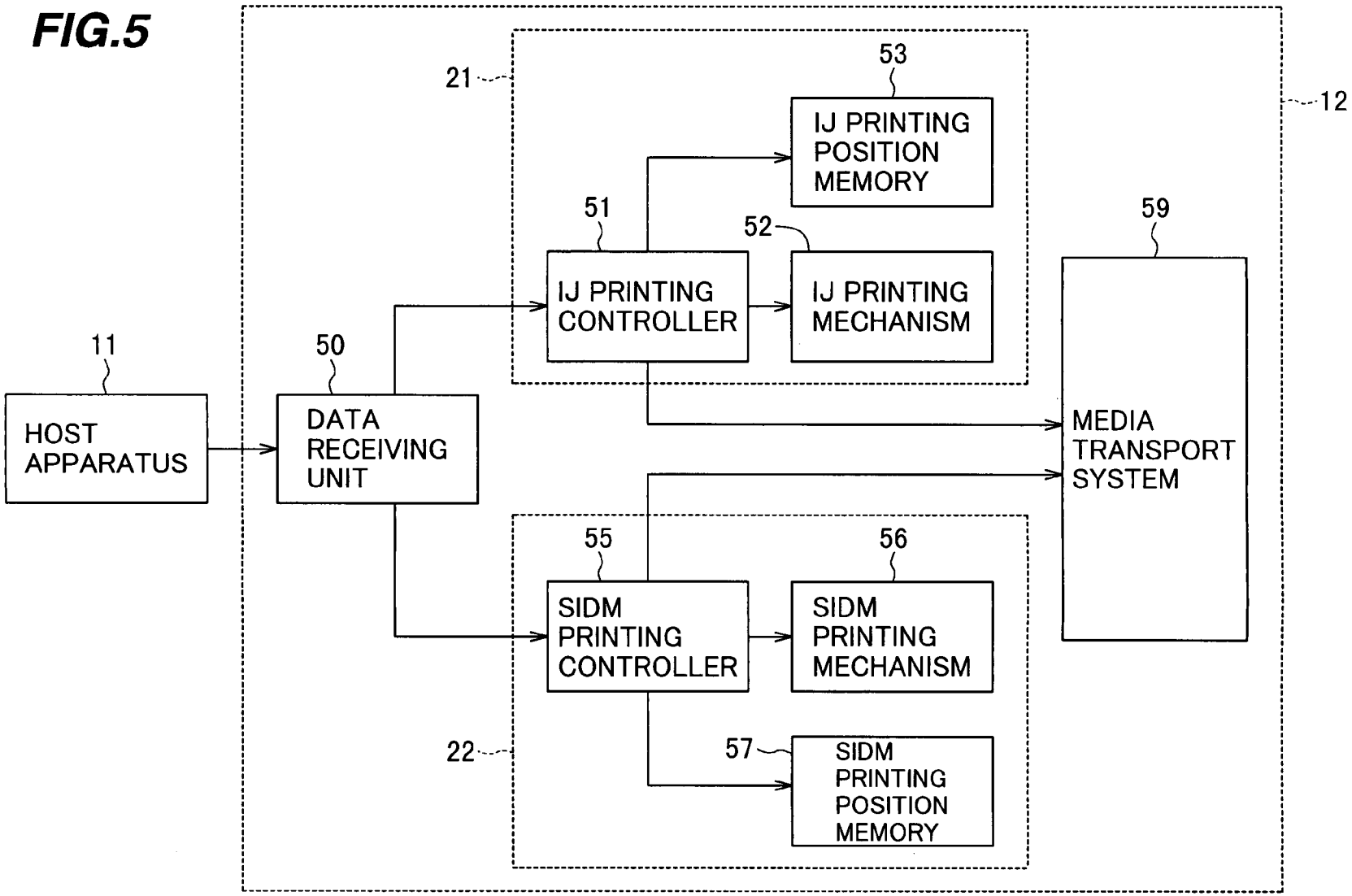
FIG. 5 is a block diagram schematically showing the structure of the image forming apparatus in the first embodiment.

The image forming apparatus 12 in the first embodiment will be further described with reference to FIG. 5. This drawing shows that the ink jet printing unit 21 comprises an ink jet printing controller 51, ink jet printing mechanism 52, and ink jet printing position memory 53, while the serial impact dot matrix printing unit 22 comprises a serial impact dot matrix printing controller 55, serial impact dot matrix printing mechanism 56, and serial impact dot matrix printing position memory 57. The image forming apparatus 12 also comprises a data receiving unit 50 and a media transport system 59.

The data receiving unit 50 receives print data DATA1 and DATA2 from the host apparatus 11, sends the first print data DATA1 to the ink jet printing controller 51, and sends the second print data DATA2 to the serial impact dot matrix printing controller 55. The ink jet printing controller 51 controls the operation of the ink jet printing mechanism 52 and ink jet printing position memory 53 according to DATA1. The ink jet printing mechanism 52 prints on the printing medium. The ink jet printing position memory 53 stores the current printing position of ink jet printing mechanism 52 on the printing medium. The serial impact dot matrix printing controller 55 controls the operation of the serial impact dot matrix printing mechanism 56 and serial impact dot matrix printing position memory 57 according to DATA2. The serial impact dot matrix printing mechanism 56 prints on the printing medium. The serial impact dot matrix printing position memory 57 stores the current printing position of the serial impact dot matrix printing mechanism 56 on the printing medium. The media transport system 59 comprises the rollers 24*a*, 24*b* shown in FIG. 2, and a driving mechanism, not shown in the drawings, for driving these rollers.

The host apparatus 11 creates print data DATA1 and DATA2 as specified by the operator, and sends the print data to the image forming apparatus 12. The print data include instructions for printing an image in a certain position on the printing medium by means of the ink jet printing unit 21 and serial impact dot matrix printing unit 22.

Figures 6A, 6B, 6C, 7:
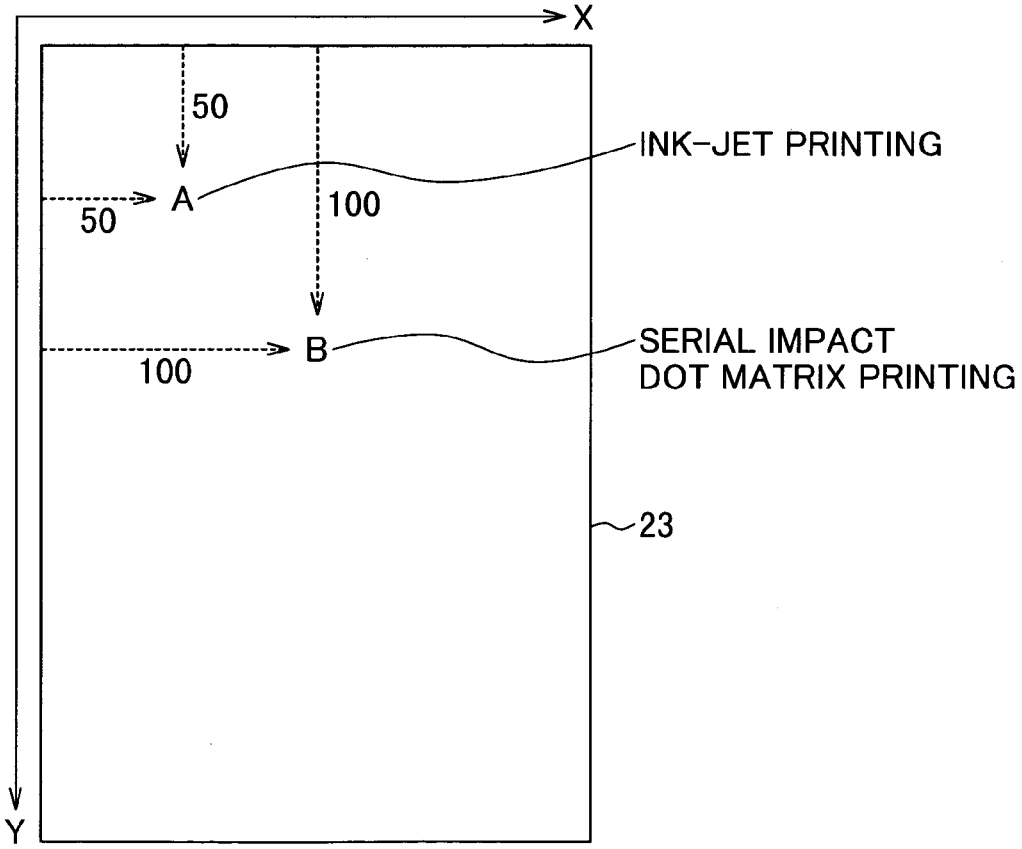
FIGS. 6A, 6B, and 6C show the structure of print data in the first embodiment.
FIG. 7 shows an example of a printout produced according to the print data shown in FIGS. 6B and 6C.

The print data sent from the host apparatus 11 in this embodiment have three blocks as shown in FIG. 6A: a printing unit selection block (1) for selecting either the ink jet printing unit 21 or the serial impact dot matrix printing unit 22, a printing position information block (2) indicating the X and Y coordinates of the printing position on the printing medium 23, and an image information block (3) indicating the image to be printed.

In the example of DATA1 shown in FIG. 6B, the printing unit selection information is set to '1', indicating that the ink jet printing unit 21 is selected. The printing position information is set to (50, 50), and the image information designates the character 'A'.

In the example of DATA2 shown in FIG. 6C, the printing unit selection information is set to '2', indicating that the serial impact dot matrix printing unit 22 is selected. The printing position information is set to (100, 100), and the image information designates the character 'B'.

The page printed according to DATA1 in FIG. 6B and DATA2 in FIG. 6C is shown in FIG. 7. The letter 'A' is printed by the ink jet printing unit 21; the letter 'B' is printed by the serial impact dot matrix printing unit 22.

The data receiving unit 50 receives the print data sent from the host apparatus 11, distinguishes DATA1 from DATA2 by the printing unit selection information, sends DATA1 to the ink jet printing controller 51, and sends DATA2 to the serial impact dot matrix printing controller 55. If the print data sent from the host apparatus 11 do not include printing unit selection information, the print data are sent to both control units.

The ink jet printing mechanism 52 operates as specified by the position information and image information sent to the ink jet printing controller 51 in DATA1. The serial impact dot matrix printing mechanism 56 operates as specified by the position information and image information sent to the serial impact dot matrix printing controller 55 in DATA2. The media transport system 59 operates according to the position information in both DATA1 and DATA2.

The ink jet printing position memory 53 is reset to '0' when the first sensor 25 detects the front edge of the printing medium 23. The serial impact dot matrix printing position memory 57 is reset to '0' when the second sensor 26 detects the front edge of the printing medium 23. After being reset, the values in the printing position memories 53, 57 are updated each time the rollers 24*a*, 24*b* advance the printing medium 23 by a distance corresponding to a single printed line. For simplicity, it will be assumed that this distance, referred to below as the linefeed distance, is the same for both the ink jet printing unit 21 and the serial impact dot matrix printing unit 22. In both the ink jet and serial impact dot matrix printing units 21, 22, a single printed line includes a plurality of simultaneously printed raster lines or dot lines. During the printing process, the linefeed distance may vary depending on whether lines of text or graphics are being printed. The position memories 53, 57 are incremented according to the motion of the printing medium 23, regardless of whether any printing actually takes place.

Figure 8A:
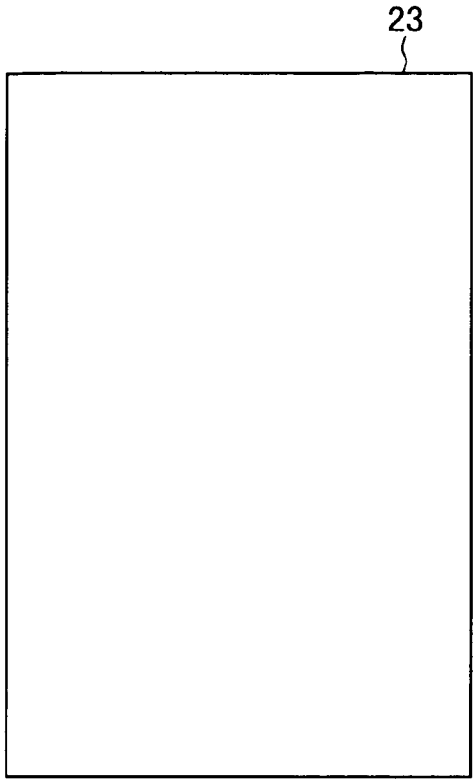
FIGS. 8A, 8B, and 8C show unprinted, printed, and copied media.
Figure 8B:
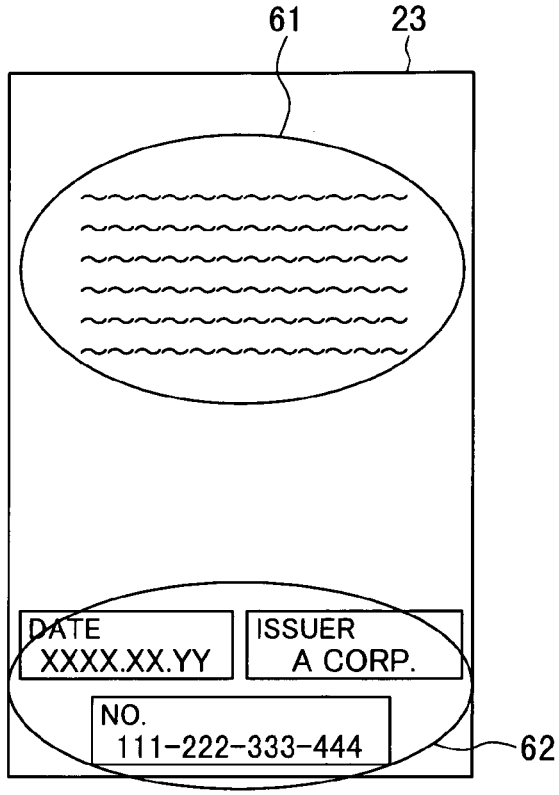

An exemplary page printed by the first embodiment will now be described. The printing media 23 used in this embodiment are cut sheets of plain white paper, as shown in FIG. 8A. Each sheet has two printed areas 61 and 62, as shown in FIG. 8B. Text is printed in the first area 61 by the ink jet printing unit 21, and identifying information, such as the date of issuance, issuer, and a serial number is printed in the second area 62 by the serial impact dot matrix printing unit 22.

Figure 8C:
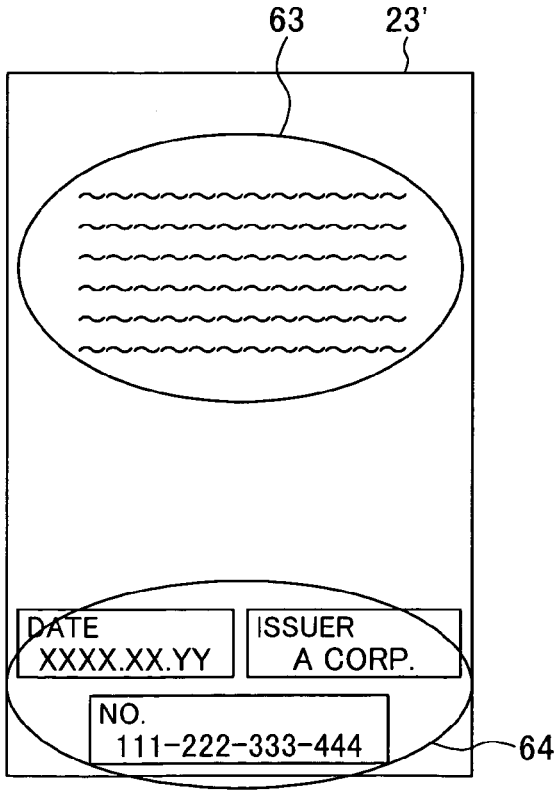

If the printed medium 23 is copied on a copying machine, which is not shown in the drawings, the copy has two printed areas 63 and 64, as shown in FIG. 8C. At a glance, the original printed image on the medium 23 shown in FIG. 8B and the copy made on the medium 23' shown in FIG. 8C seem to be the same.

Figure 9A:
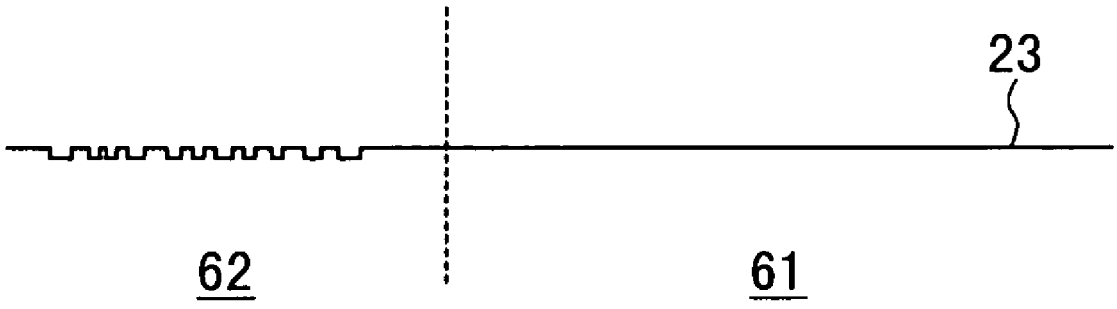
FIGS. 9A and 9B show a difference between the original in FIG. 8B and the copy in FIG. 8C.
Figure 9B:
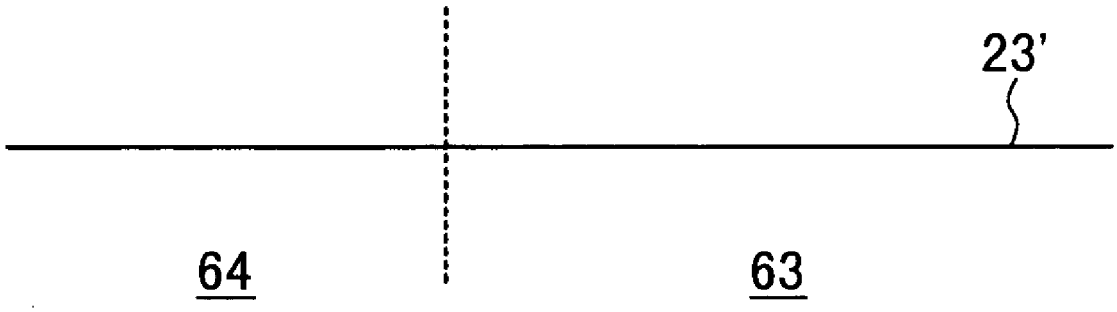

Side views of the media, however, show a difference between the original and the copy. The identifying information printed in area 62 on the original printing medium 23 by the serial impact dot matrix printing unit 22 is embossed, as shown in FIG. 9A. The copy of the identifying information in area 64 of the copy is not embossed, as shown in FIG. 9B. Therefore, the printing medium 23 on which the original image was printed can be distinguished from the printing medium 23' on which the copy is printed by checking whether the identifying information is embossed as well as printed.

Figure 10:
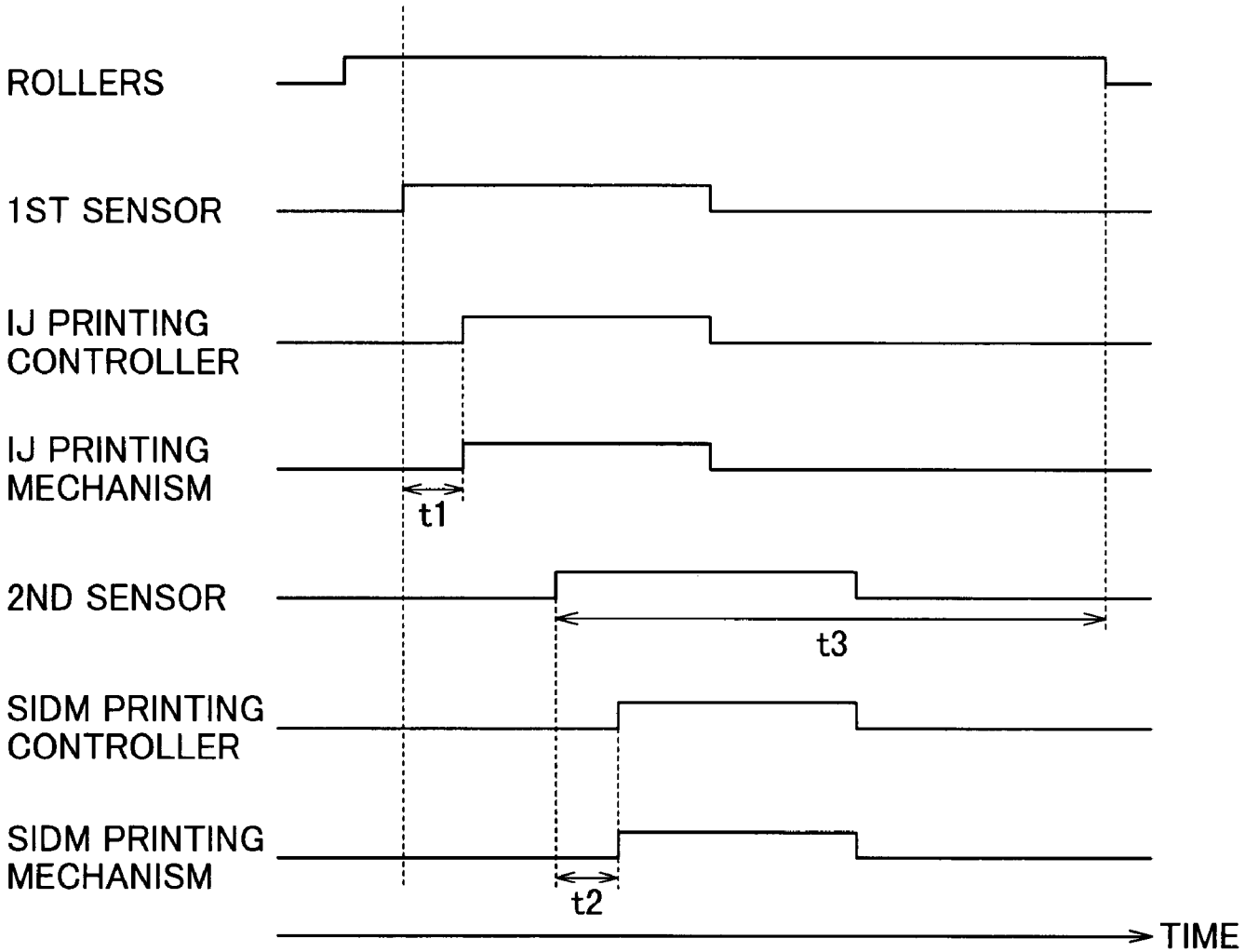
FIG. 10 is a timing diagram illustrating the operation of different components of the image forming apparatus in the first embodiment.
Figure 11:
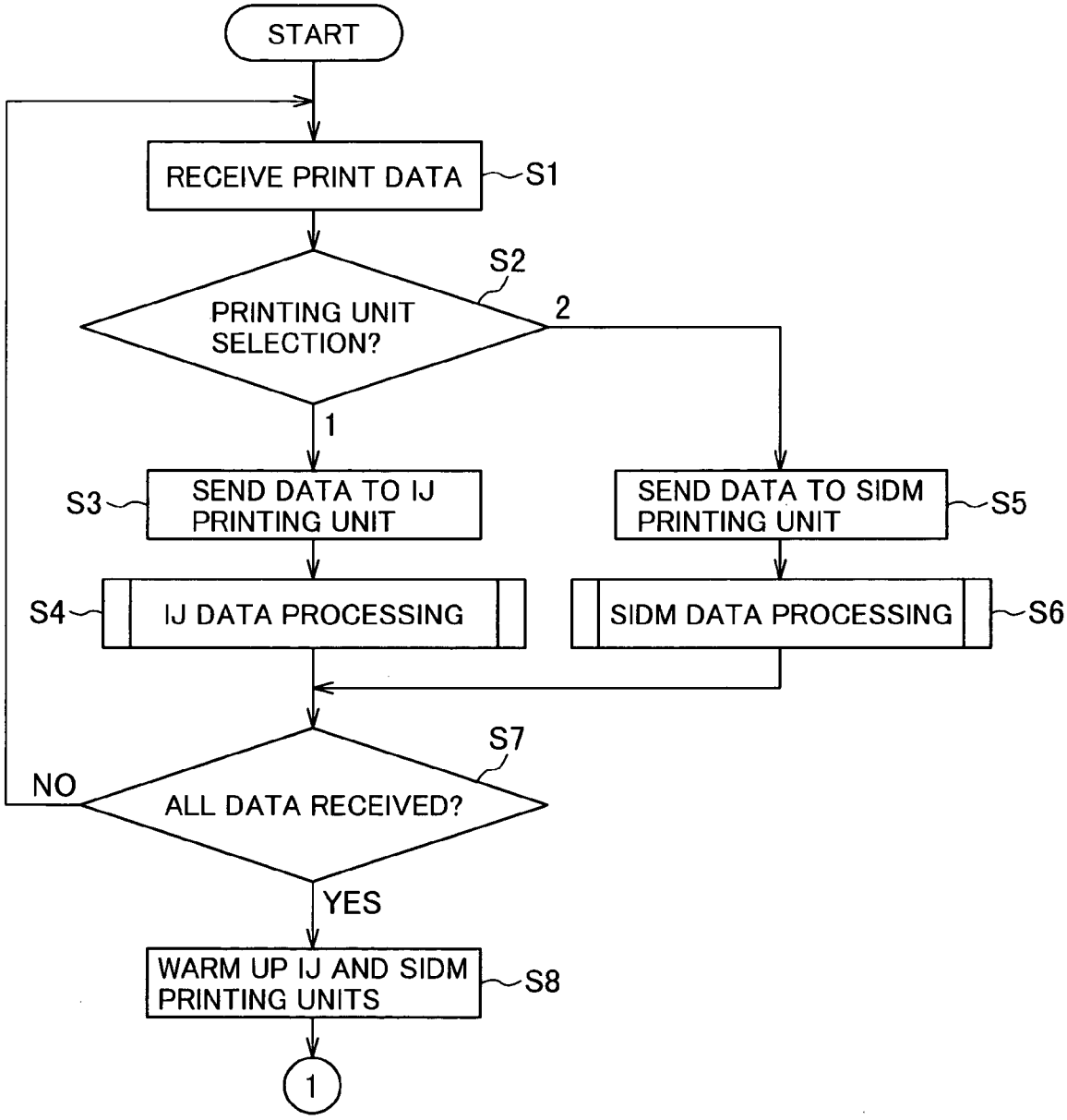
FIGS. 11 and 12 constitute a flowchart illustrating the operation of the image forming apparatus in the first embodiment.
Figure 12:
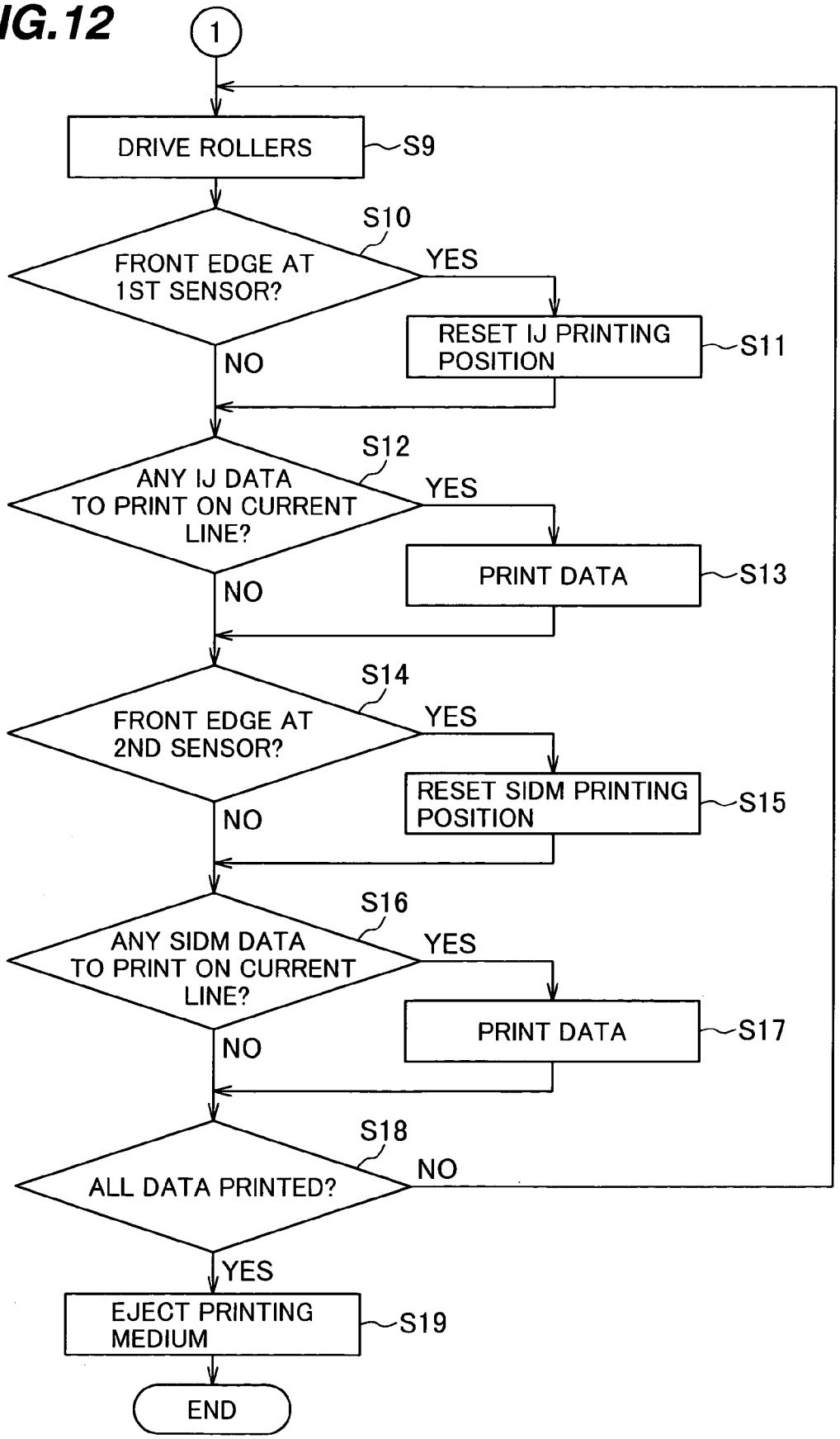

The operation of the image forming apparatus 12 in the first embodiment will now be described with reference to FIGS. 10 to 12. FIG. 10 is a timing diagram illustrating the operation of different components of the image forming apparatus 12. In each waveform in FIG. 10, the high level indicates that the component is active and the low level indicates the inactive state. For example, in the first waveform the high level indicates that the rollers are turning (intermittently). In the second waveform, the high level indicates that the first sensor senses the presence of the printing medium. FIGS. 11 and 12 constitute a flowchart illustrating the printing of a page of the image forming apparatus 12.

In step S1 (FIG. 11), the data receiving unit 50 receives print data sent from the host apparatus 11.

In step S2, the data receiving unit 50 reads the printing unit selection information included in the print data. If the printing unit selection information is set to '1', the data receiving unit 50 identifies the print data as DATA1, intended for the ink jet printing unit 21, and the processing proceeds to step S3. If the printing unit selection information is set to '2', the data receiving unit 50 identifies the print data as DATA2, intended for the serial impact dot matrix printing unit 22, and the processing proceeds to step S5.

In step S3, the data receiving unit 50 sends DATA1 to the ink jet printing unit 21.

In step S4, the ink jet printing unit 21 receives and processes DATA1 and stores the resulting image information in raster data format.

In step S5, the data receiving unit 50 sends DATA2 to the serial impact dot matrix printing unit 22.

In step S6, the serial impact dot matrix printing unit 22 receives and processes DATA2 and stores the resulting image information in raster data format.

In step S7, the data receiving unit 50 decides whether all print data for the page have been received from the host apparatus 11. If so, the processing proceeds to step S8. If not, the processing returns to step S1, and the data receiving unit 50 continues receiving the print data.

In step S8, the ink jet printing unit 21 and serial impact dot matrix printing unit 22 start warming up.

In step S9 (FIG. 12), the media transport system 59 drives the rollers 24*a*, 24*b* to advance the printing medium 23, thus performing a linefeed. The values in the ink jet printing position memory 53 and serial impact dot matrix printing position memory 57 are incremented accordingly.

In step S10, the ink jet printing unit 21 checks whether the first sensor 25 has just detected the front edge of the printing medium 23. If so, that is, if the output of the first sensor 25 has just changed from the state indicating that the printing medium 23 is not present to the state indicating that the printing medium 23 is present, the processing proceeds to step S11. If not, the processing proceeds to step S12.

In step S11, the ink jet printing position memory 53 is reset to '0'.

In step S12, the ink jet printing unit 21 determines its current line position on the printing medium 23 by subtracting a fixed quantity from the value indicated by the ink jet printing position memory 53, and checks whether DATA1 includes any data to be printed on the current line. If so, the processing proceeds to step S13. If not, the processing proceeds to step S14. The fixed quantity is spatially equivalent to the distance from the first sensor 25 to the ink jet printing head, and temporally equivalent to time t1 in FIG. 10.

In step S13, the ink jet printing unit 21 reads the necessary number of rasters of stored data and prints the current line.

In step S14, the serial impact dot matrix printing unit 22 checks whether the second sensor 26 has just detected the front edge of the printing medium 23. If so, that is, when the output of the second sensor 26 changes from the state indicating that the printing medium 23 is not present to the state indicating that the printing medium 23 is present, the processing proceeds to step S15. If not, the processing proceeds to step S16.

In step S15, the serial impact dot matrix printing position memory 57 is reset to '0'.

In step S16, the serial impact dot matrix printing unit 22 determines its current line position on the printing medium 23 by subtracting a fixed quantity, equivalent to the distance from the second sensor 26 to the dot impact printing head or to time t2 in FIG. 10, from the value indicated by the serial impact dot matrix printing position memory 57, and checks whether DATA2 includes any data to be printed on the current line. If so, the processing proceeds to step S17. If not, the processing proceeds to step S18.

In step S17, the serial impact dot matrix printing unit 22 reads the necessary number of rasters of stored data and prints the current line.

In step S18, the image forming apparatus 12 decides whether the printing of all data has been completed, that is, whether the printing of both DATA1 by the ink jet printing unit 21 and DATA2 by the serial impact dot matrix printing unit 22 has been finished. If so, the processing proceeds to step S19. If not, the processing returns to step S9.

In step S19, a media ejection distance is calculated by subtracting the position indicated by the serial impact dot matrix printing position memory 57 from a known distance substantially equal to the sum of the maximum media length and the distance from the second sensor 26 to roller 24*b*. This known distance is equivalent to time t3 in FIG. 10. Roller 24*b* is rotated for a time equivalent to the media ejection distance to eject the printing medium 23; then the processing ends.

The processing loop from step S9 to step S18 includes necessary delays for the printing operations in steps S13 and S17, during which the rotation of the rollers 24*a*, 24*b* is stopped. Although the two printing steps S13 and S17 may sometimes take place simultaneously, the ink jet printing unit 21 can print faster than the serial impact dot matrix printing unit 22. The loop from step S9 to step S18 is therefore repeated at a faster rate when only the ink jet printing unit 21 prints than when the serial impact dot matrix printing unit 22 prints. When the printing steps S13 and S17 are not performed, the rollers 24*a*, 24*b* are driven substantially continuously.

The identifying information printed in area 62 by the serial impact dot matrix printing unit 22 differs from the text printed in area 61 by the ink jet printing unit 21 in that the identifying information is embossed. This difference cannot be copied by a copying machine. The printing medium 23 bearing the original printed image can therefore be distinguished from media bearing copies of the original printed image, so that copies can be identified as such and the problems associated with unidentified copies can be avoided. In addition, because the serial impact dot matrix printing unit 22 prints on just a part of the printing medium 23, the attendant reduction in printing speed can be minimized.

Figure 13:
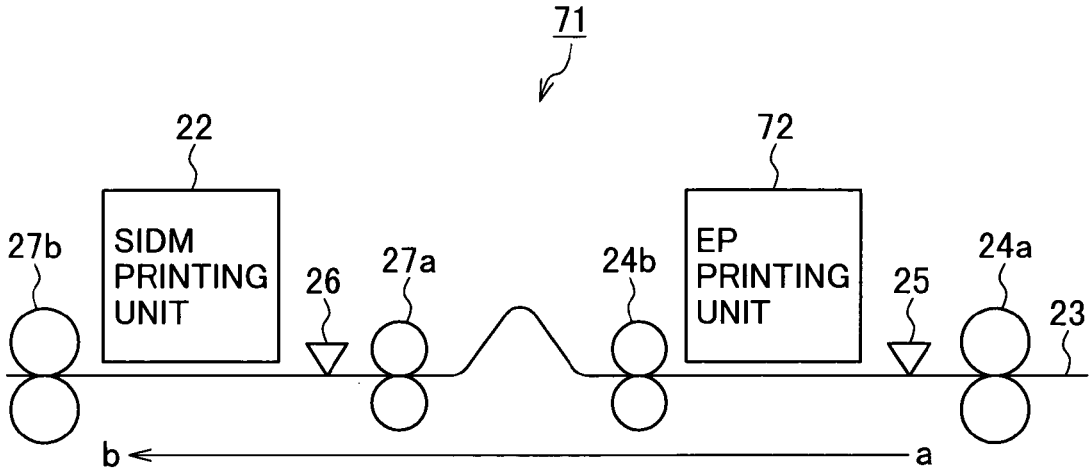
FIG. 13 shows the general arrangement of the image forming part of the image forming apparatus in a second embodiment.

A second embodiment of the present invention will now be described. Referring to FIG. 13, the image forming apparatus 71 in the second embodiment comprises an electrophotographic (EP) printing unit 72, which is provided as a first image forming unit, a serial impact dot matrix printing unit 22, which is provided as a second image forming unit, a first pair of rollers 24*a*, 24*b*, a pair of sensors 25, 26, and a second pair of rollers 27*a*, 27*b*. The rollers transport printing media 23 in the direction from 'a' to 'b'.

Rollers 24*a* and 24*b* transport the printing medium 23 according to the position detected by the first sensor 25. When the printing medium 23 reaches an appropriate position, the electrophotographic printing unit 72 prints an image according to DATA1. Rollers 27*a* and 27*b* transport the printing medium 23 further according to the position detected by the second sensor 26. When the printing medium 23 reaches an appropriate position, the serial impact dot matrix printing unit 22 prints an image according to DATA2. Images based on DATA1 and DATA2 can both be printed on a single page.

Figure 14:
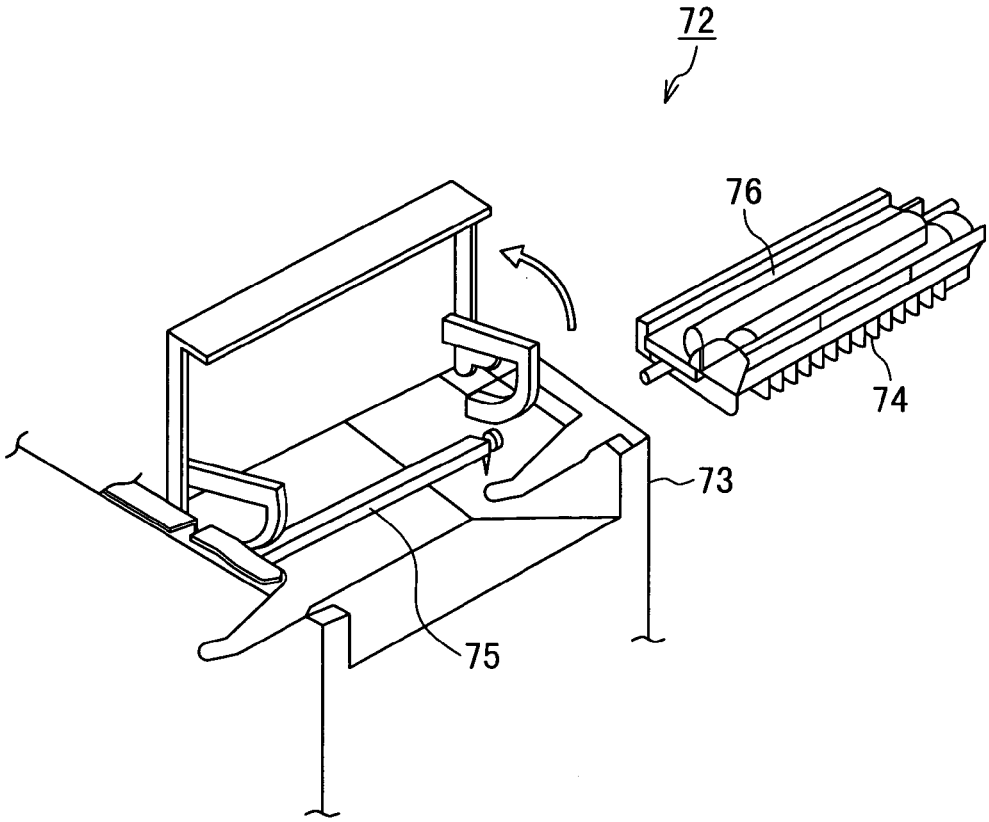
FIG. 14 is a perspective view of the electrophotographic printing unit in the second embodiment.

As shown in FIG. 14, the electrophotographic printing unit 72 comprises a main unit 73 and a process unit 74. The main unit 73 includes a light-emitting-diode (LED) head 75; the process unit 74 includes a photosensitive drum 76 or other image forming member. As in the prior art, the surface of the photosensitive drum 76 is electrically charged, then illuminated by the LED head 75, forming an electrostatic latent image. A toner image is formed by applying toner (not shown) to the latent image, then is transferred and fused onto the printing medium 23.

The serial impact dot matrix printing unit 22 provided as a second image forming unit has the same structure as in the first embodiment.

In the second embodiment, rollers 24*a* and 24*b* rotate continuously; rollers 27*a* and 27*b* rotate in short angular steps, that is, rollers 27*a* and 27*b* go through repeated start-and-stop cycles. While the first pair of rollers 24*a*, 24*b* are rotating continuously, the electrophotographic printing unit 72 prints continuously. While the second pair of rollers 27*a*, 27*b* are stopped, the serial impact dot matrix printing unit 22 prints a single line. In order to smooth out temporary transport speed discrepancies, slack is provided in the printing medium 23 between the electrophotographic printing unit 72 and the serial impact dot matrix printing unit 22.

Figure 15A:
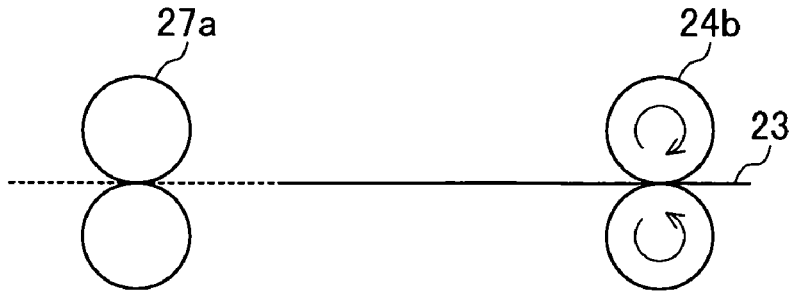
FIGS. 15A, 15B, 15C, 15D, and 15E illustrate various stages of media transport in the second embodiment.
Figure 15B:
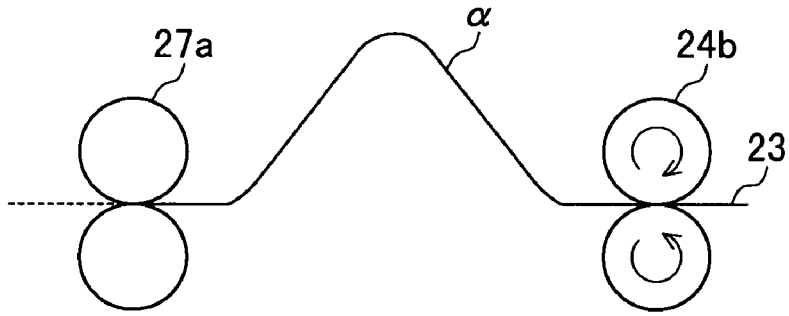
Figure 15C:
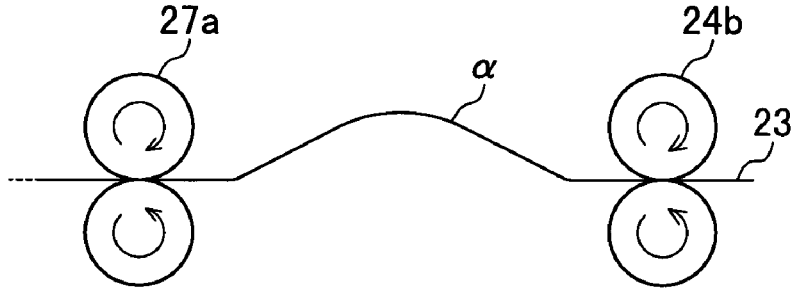
Figure 15D:
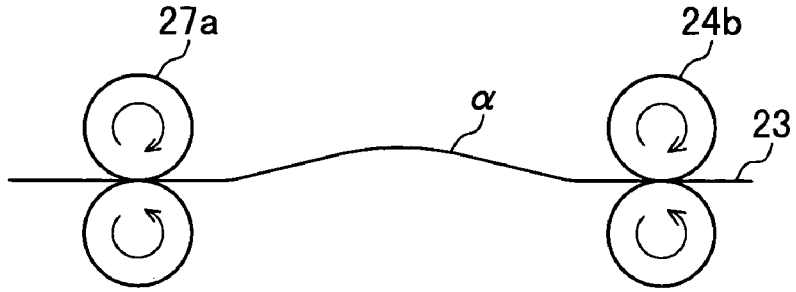
Figure 15E:
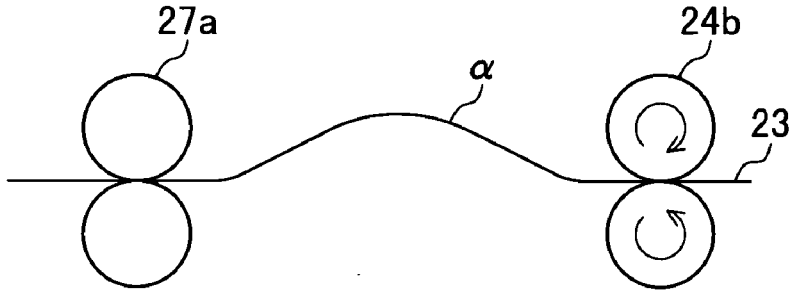

FIGS. 15A to 15E show an example of how the slack in the media changes in the second embodiment. While the front edge of the printing medium 23 is advancing toward roller 27*a* as shown in FIG. 15A, roller 27*a* is held stopped. When the front edge of the printing medium 23 reaches roller 27*a*, roller 27*a* remains stopped while roller 24*b* continues to rotate and transport the printing medium 23, creating slack $\alpha$ as shown in FIG. 15B. After a time equivalent to at least one line printing cycle by the serial impact dot matrix printing unit 22, roller 27*a* starts rotating at a speed faster than roller 24*b*, and the slack $\alpha$ is reduced as shown in FIGS. 15C and 15D. After feeding the printing medium 23 through a distance equal to one line printed by the serial impact dot matrix printing unit 22, roller 27*a* stops rotating and the slack $\alpha$ increases again, as shown in FIG. 15E. While the rollers 27*a*, 27*b* are being driven intermittently, rollers 24*a*, 24*b* are driven at the same average media transport speed.

Figure 16:
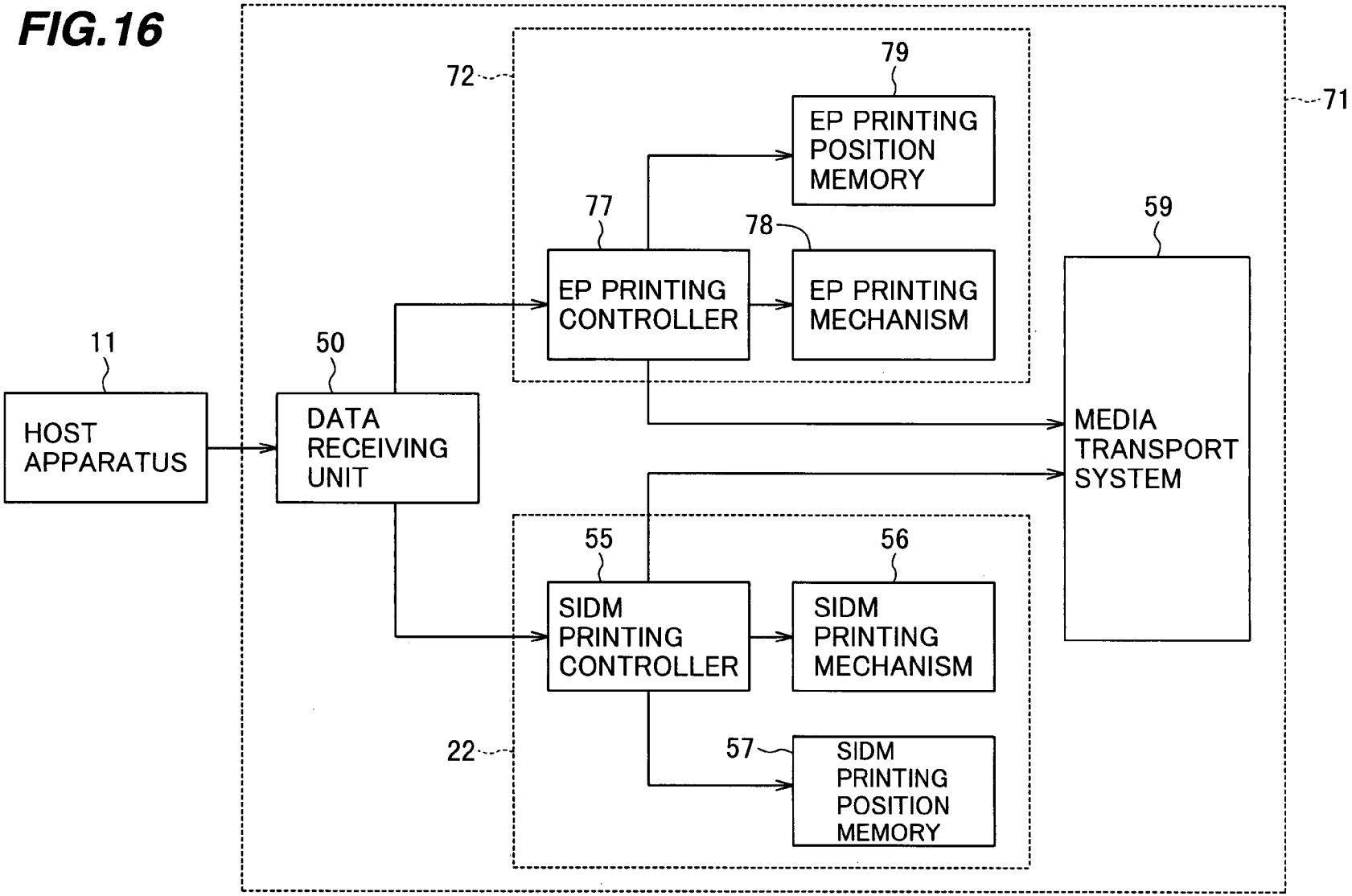
FIG. 16 is a block diagram schematically showing the structure of the image forming apparatus in the second embodiment.

As shown in FIG. 16, the image forming apparatus 71 comprises a data receiving unit 50, the electrophotographic printing unit 72, the serial impact dot matrix printing unit 22, and a media transport system 59. The electrophotographic printing unit 72 comprises an electrophotographic printing controller 77, electrophotographic printing mechanism 78, and electrophotographic printing position memory 79; the serial impact dot matrix printing unit 22 comprises a serial impact dot matrix printing controller 55, serial impact dot matrix printing mechanism 56, and serial impact dot matrix printing position memory 57.

The data receiving unit 50 receives print data comprising DATA1 and DATA2 from the host apparatus 11, sends DATA1 to the electrophotographic printing controller 77 in the electrophotographic printing unit 72, and sends DATA2 to the serial impact dot matrix printing controller 55 in the serial impact dot matrix printing unit 22. The electrophotographic printing controller 77 controls the operation of the electrophotographic printing mechanism 78 and electrophotographic printing position memory 79 according to DATA1. The electrophotographic printing mechanism 78 prints on the printing medium 23. The electrophotographic printing position memory 79 stores the current printing position of the electrophotographic printing mechanism 78 on the printing medium 23.

The serial impact dot matrix printing unit 22 and media transport system 59 operate generally as in the first embodiment, except that the media transport system 59 controls two pairs of rollers 24*a*, 24*b* and 27*a*, 27*b*.

The host apparatus 11 creates print data DATA1 and DATA2 as specified by the operator and sends the print data to the image forming apparatus 12. The print data include instructions for printing an image in a certain position on the printing medium 23 by means of the electrophotographic printing unit 72 or serial impact dot matrix printing unit 22. The print data have the same structure as in the first embodiment.

The data receiving unit 50 receives the print data sent from the host apparatus 11, distinguishes DATA1 from DATA2 by the printing unit selection information, sends DATA1 to the electrophotographic printing controller 77, and sends DATA2 to the serial impact dot matrix printing controller 55. If the print data sent from the host apparatus 11 do not include printing unit selection information, the print data are sent to both control units. The printing algorithm in the second embodiment is the same as in the first embodiment.

The electrophotographic printing mechanism 78 operates as specified by the position information and image information sent to the electrophotographic printing controller 77 in DATA1. The serial impact dot matrix printing mechanism 56 operates as specified by the position information and image information sent to the serial impact dot matrix printing controller 55 in DATA2. The media transport system 59 operates according to the position information in both DATA1 and DATA2.

Figure 17A:
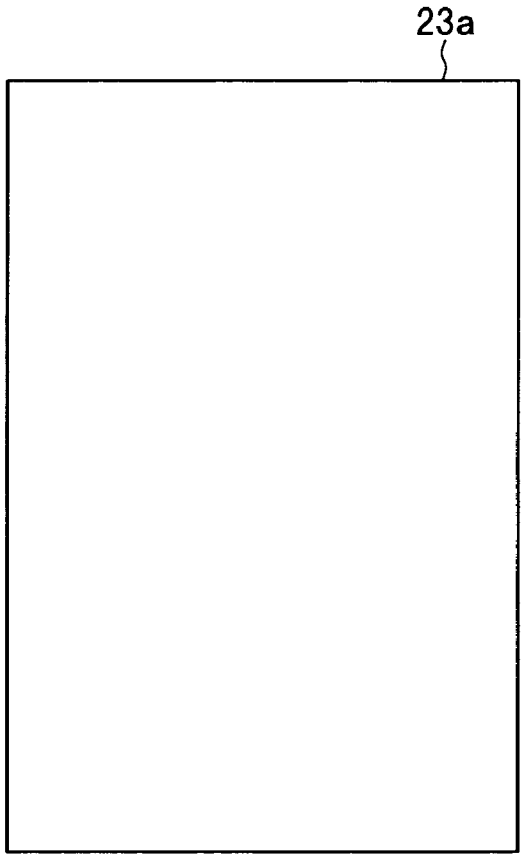
FIGS. 17A and 17B show a pair of media sheets that, when attached, constitute a two-ply pressure-sensitive form used in the second embodiment.
Figure 17B:
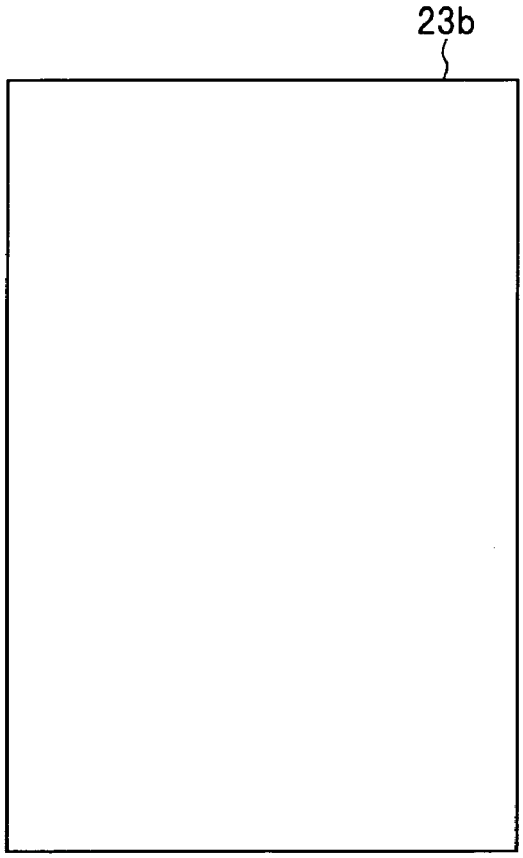

An exemplary page printed by the second embodiment will now be described. The printing media 23 used in this embodiment are two-ply blank pressure-sensitive forms comprising two sheets of paper detachably joined together at the front edge. For clarity, the two sheets are shown detached in FIGS. 17A and 17B. When pressure is applied to the two-ply form, the same image is printed on the top sheet 23*a* and the bottom sheet 23*b*.

Figure 18A:
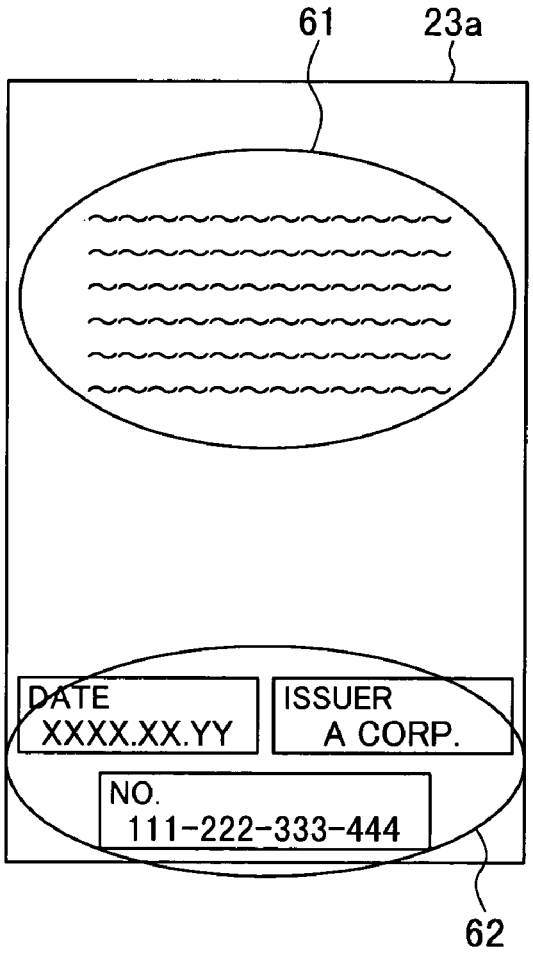
FIGS. 18A and 18B show the same pair of media sheets after printing in the second embodiment.
Figure 18B:
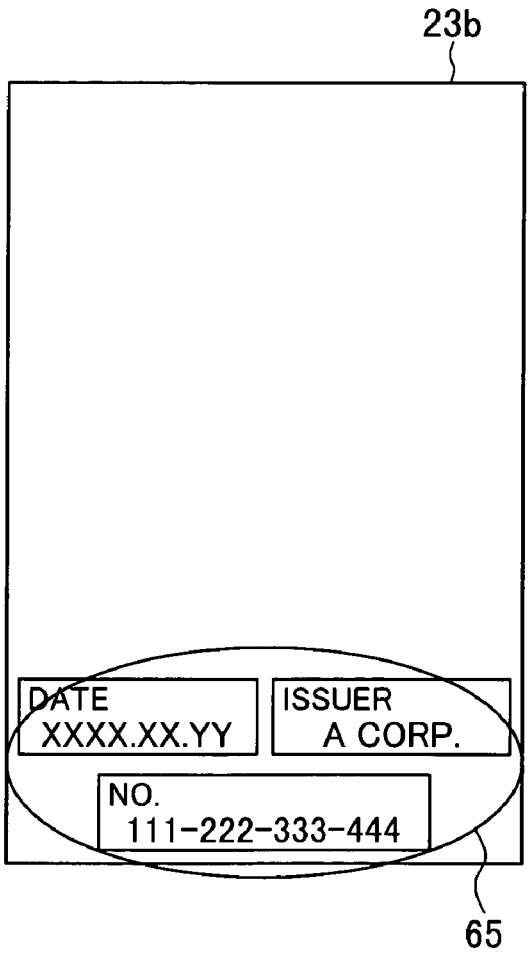

After a form is printed by the image forming apparatus 71, the top sheet 23*a* has two printed areas 61 and 62, as shown in FIG. 18A. The text in area 61 is printed by the electrophotographic printing unit 72, and identifying information such as the of date of issuance, issuer, and a serial number are printed by the serial impact dot matrix printing unit 22. The bottom sheet 23*b* has only one printed area 65 with the same identifying information as in area 62, as shown in FIG. 18B. Since the text in area 61 is not printed on the bottom sheet 23*b*, the bottom sheet 23*b* can be used for document management with a high level of security.

The serial impact dot matrix printing mechanism 56 provided as a second image forming unit in this embodiment has an impact mechanism capable of forming images on multiple-ply pressure-sensitive media.

Figure 19:
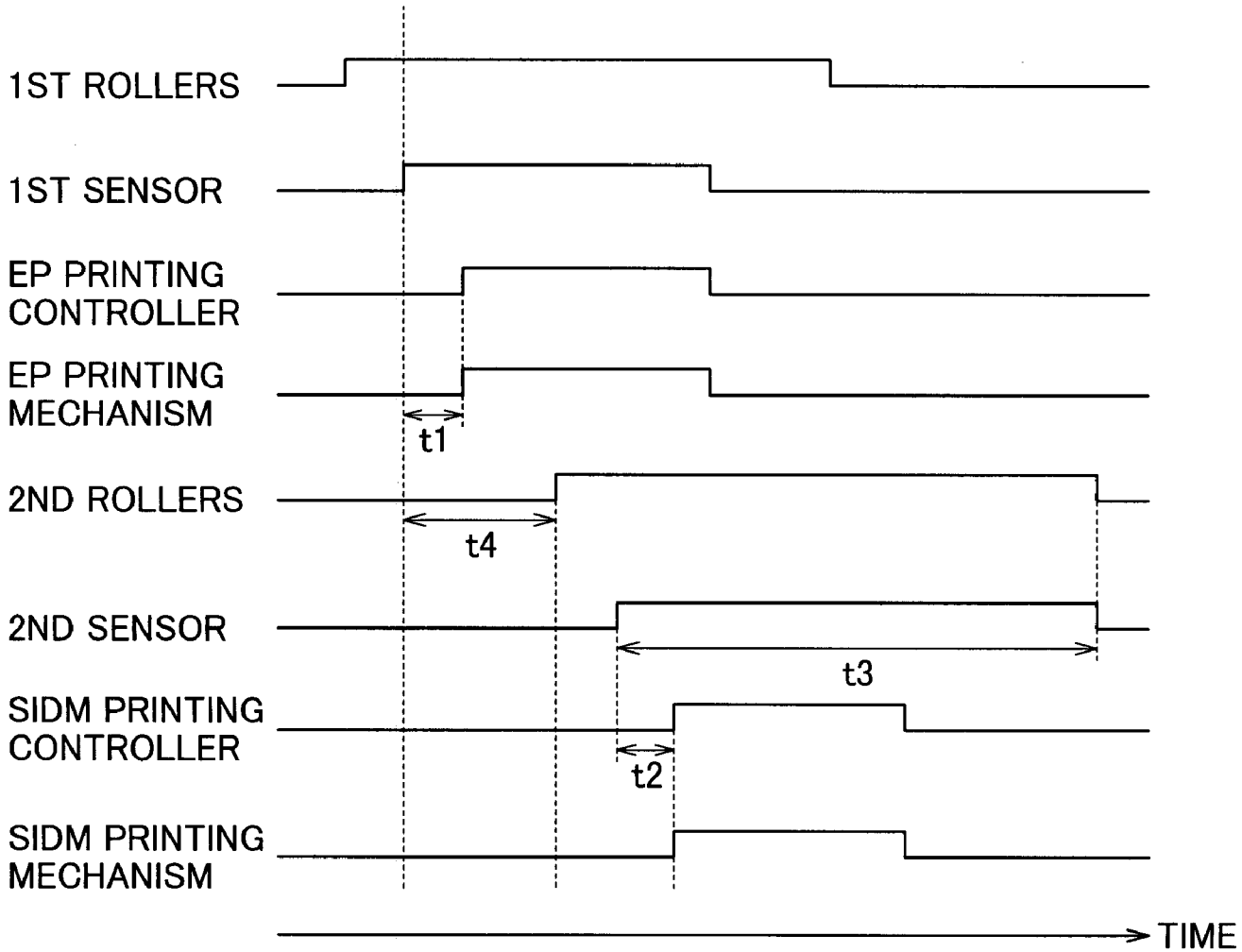
FIG. 19 is a timing diagram illustrating the operation of different components of the image forming apparatus in the second embodiment.
Figure 20:
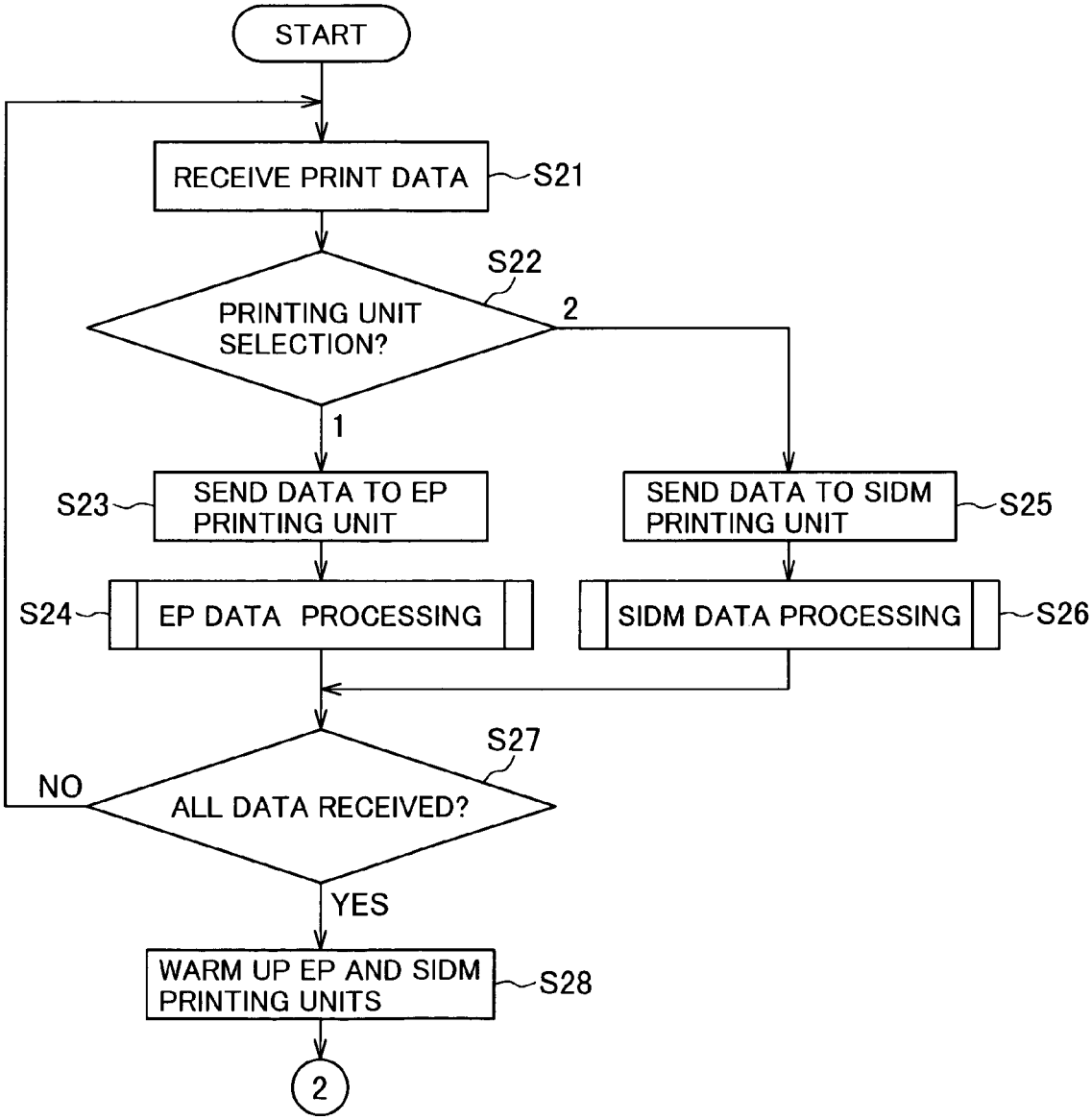

The operation of the image forming apparatus 71 in the second embodiment will now be described with reference to the following drawings. FIG. 19 is a timing diagram illustrating the operation of different components of the image forming apparatus 71, the high waveform level indicating the active state and the low level the inactive state of the corresponding component. FIGS. 20 and 21 constitute a flowchart illustrating the operation of the image forming apparatus 71.

In step S21 (FIG. 20), the data receiving unit 50 receives the print data sent from the host apparatus 11.

In step S22, the data receiving unit 50 reads the printing unit selection information included in the print data. If the printing unit selection information is set to '1', the data receiving unit 50 identifies the print data as DATA1, intended for the electrophotographic printing unit 72, and the processing proceeds to step S23. If the printing unit selection information is set to '2', the data receiving unit 50 identifies the print data as DATA2, intended for the serial impact dot matrix printing unit 22, and the processing proceeds to step S25.

In step S23, the data receiving unit 50 sends DATA1 to the electrophotographic printing unit 72.

In step S24, the electrophotographic printing unit 72 receives and processes DATA1 and stores the resulting image information in raster data format.

In step S25, the data receiving unit 50 sends DATA2 to the serial impact dot matrix printing unit 22.

In step S26, the serial impact dot matrix printing unit 22 receives and processes DATA2 and stores the resulting image information in raster data format.

In step S27, the data receiving unit 50 decides whether all print data have been received from the host apparatus 11. If so, the processing proceeds to step S28. If not, the processing returns to step S21, and the data receiving unit 50 continues receiving the print data.

In step S28, the electrophotographic printing unit 72 and serial impact dot matrix printing unit 22 start warming up.

In step S29 (FIG. 21), the media transport system 59 is activated. Rollers 24*a* and 24*b* begin rotating and continue to rotate until the trailing edge of the printing medium 23 passes the second sensor 26. Each time rollers 24*a* and 24*b* advance the printing medium 23 by a distance corresponding to a single dot line printed by the electrophotographic printing unit 72, the value in the electrophotographic printing position memory 79 is incremented by one.

In step S30, the electrophotographic printing unit 72 checks whether the first sensor 25 has just detected the front edge of the printing medium 23. If so, that is, if the output of the first sensor 25 has just changed from the state indicating that the printing medium 23 is not present to the state indicating that the printing medium 23 is present, the processing proceeds to step S31. If not, the processing proceeds to step S32.

In step S31, the electrophotographic printing position memory 79 is reset to '0'.

In step S32, the electrophotographic printing unit 72 determines its current dot line position on the printing medium 23 by subtracting a fixed number of dot lines from the value indicated by the electrophotographic printing position memory 79, and checks whether DATA1 includes any data to be printed on the current dot line. A dot line is equivalent to a single raster line of print data. The fixed number of dot lines corresponds substantially to the distance from the first sensor 25 to the photosensitive drum 76 in the electrophotographic printing unit 72, and is equivalent to time t1 in FIG. 19. If DATA1 includes data to be printed on the current dot line, the processing proceeds to step S33. If not, the processing proceeds to step S34.

In step S33, the electrophotographic printing unit 72 prints one dot line of stored data on the first sheet of the multiple-ply form.

In step S34, the serial impact dot matrix printing unit 22 decides whether the printing medium 23 has been advanced far enough to reach roller 27*a* and produce the slack $\alpha$ shown in FIG. 15B. This decision is made by determining the distance traveled by the printing medium 23 after detection of its front edge by the first sensor 25. The necessary distance is equal to the distance from the first sensor 25 to roller 27*a* plus at least the linefeed distance of the serial impact dot matrix printing unit 22, and is equivalent to time t4 in FIG. 19. The decision is thus equivalent to determining whether time t4 has elapsed, as indicated in FIG. 21.

When the printing medium 23 has advanced the necessary distance, and at fixed intervals thereafter, the processing proceeds to step S35. At other times, the processing proceeds to step S36. The fixed intervals are equal to the line printing cycle time of the serial impact dot matrix printing unit 22, that is, to the time required for the serial impact dot matrix printing mechanism 56 to print one line and the second pair of rollers 27*a*, 27*b* to feed the printing medium 23 to the next line position. As in the first embodiment, a line printed by the serial impact dot matrix printing unit 22 comprises a plurality of dot lines.

In step S35, rollers 27*a* and 27*b* rotate through an angle corresponding to the linefeed distance of the serial impact dot matrix printing unit 22, and the serial impact dot matrix printing position memory 57 is incremented correspondingly. After completing the linefeed, rollers 27*a* and 27*b* stop temporarily.

In step S36, the serial impact dot matrix printing unit 22 checks whether the second sensor 26 has just detected the front edge of the printing medium 23. If so, that is, if the output of the second sensor 26 has just changed from the state indicating that the printing medium 23 is not present to the state indicating that the printing medium 23 is present, the processing proceeds to step S37. If not, the processing proceeds to step S38.

In step S37, the serial impact dot matrix printing position memory 57 is reset to '0'.

In step S38, the serial impact dot matrix printing unit 22 determines its current line position on the printing medium 23 by subtracting a fixed quantity, equivalent the distance from the second sensor 26 to the dot impact printing head or to time t2 in FIG. 19, from the value indicated by the serial impact dot matrix printing position memory 57, and checks whether DATA2 includes any data to be printed on the current line. If so, the processing proceeds to step S39. If not, the processing proceeds to step S40.

In step S39, the serial impact dot matrix printing unit 22 reads the necessary number of rasters of stored data and prints the current line on the first sheet of the multiple-ply form. Identifying information printed in area 62 is copied onto the second sheet of the multiple-ply form. During this step, rollers 27*a* and 27*b* remain stationary, while rollers 24*a* and 24*b* continue to rotate and the electrophotographic printing unit 72 continues to print, if it has data to be printed.

In step S40, the image forming apparatus 71 decides whether the printing of all print data has been completed, that is, whether printing based on both DATA1 for the electrophotographic printing unit 72 and DATA2 for the serial impact dot matrix printing unit 22 has been finished. If so, the processing proceeds to step S41. If not, the processing returns to step S30.

In step S41, a media ejection distance is calculated by subtracting the position indicated by the serial impact dot matrix printing position memory 57 from a known distance substantially equal to the sum of the maximum media length and the distance from the second sensor 26 to roller 27*b*. This known distance is equivalent to time t3 in FIG. 19. Roller 27*b* is rotated for a time equivalent to the media ejection distance to eject the printing medium 23; then the processing ends.

Although not indicated in the drawings, the rotational speed of rollers 24*a* and 24*b* is preferably varied during the printing of the page. Before the serial impact dot matrix printing unit 22 begins printing, the rollers 24*a* and 24*b* are preferably driven at the normal printing speed of the electrophotographic printing unit 72. While the serial impact dot matrix printing unit 22 is printing, rollers 24*a* and 24*b* are slowed to match the printing speed of the serial impact dot matrix printing unit 22; that is, to match the average rotational speed of rollers 27*a* and 27*b*. When the serial impact dot matrix printing unit 22 prints on just part of a page, as in FIG. 18A, this arrangement minimizes the attendant reduction in printing speed.

Regardless of printing speed, the electrophotographic printing unit 72 prints at a higher resolution than the serial impact dot matrix printing unit 22, so a high-quality text image can be combined with the printing and copying of document management information.

The printing media 23 used in this embodiment are two-ply forms attached at one edge, and they are transported together as if they were a single sheet of paper, but the invention is not limited to this very simple type of multiple-ply media and media transport. Any type of multiple-ply media may be used. The different sheets may be fed and ejected through different paths.

A third embodiment of the present invention will now be described, omitting detailed descriptions of aspects of the structure, operation, and effects that are the same as in the first or second embodiment.

Figure 22:
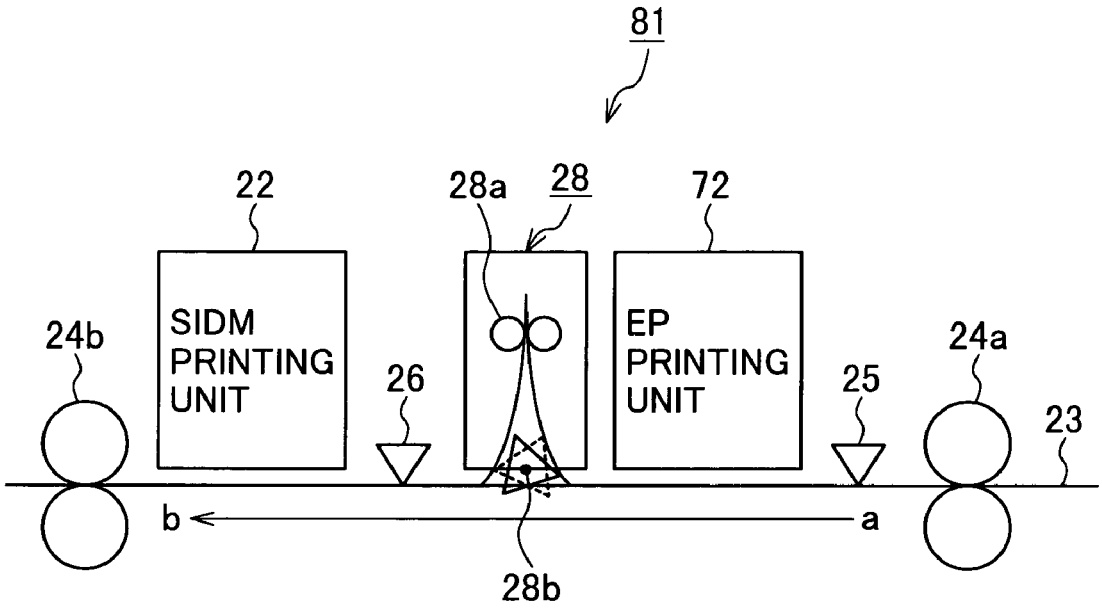
FIG. 22 shows the general arrangement of the image forming part of the image forming apparatus in a third embodiment.

Referring to FIG. 22, the image forming apparatus 81 of the third embodiment comprises an electrophotographic printing unit 72, which is provided as a first image forming unit, a serial impact dot matrix printing unit 22, which is provided as a second image forming unit, a pair of rollers 24*a*, 24*b*, a pair of sensors 25, 26, and a media turnover unit 28. The rollers 24*a*, 24*b* transport the printing medium 23 in the direction from 'a' to 'b'.

The electrophotographic printing unit 72 has the same structure as in the second embodiment, and the serial impact dot matrix printing unit 22 has the same structure as in the second embodiment, except that it does not use an inked ribbon.

Roller 24*a* transports the printing medium 23 according to the position detected by the first sensor 25. When the printing medium 23 reaches an appropriate position, the electrophotographic printing unit 72 prints an image according to DATA1 received from the host apparatus 11. A reversing roller 28*a* and a triangular switchback roller 28*b* in the media turnover unit 28 then turn the printing medium 23 over for printing on the reverse side. Roller 24*b* transports the printing medium 23 further according to the position detected by the second sensor 26. When the printing medium 23 reaches an appropriate position, the serial impact dot matrix printing unit 22 prints an embossed image according to DATA2. The embossed image is visible on both sides of the printing medium 23, although it does not differ in color from the background of the page.

Figure 23:
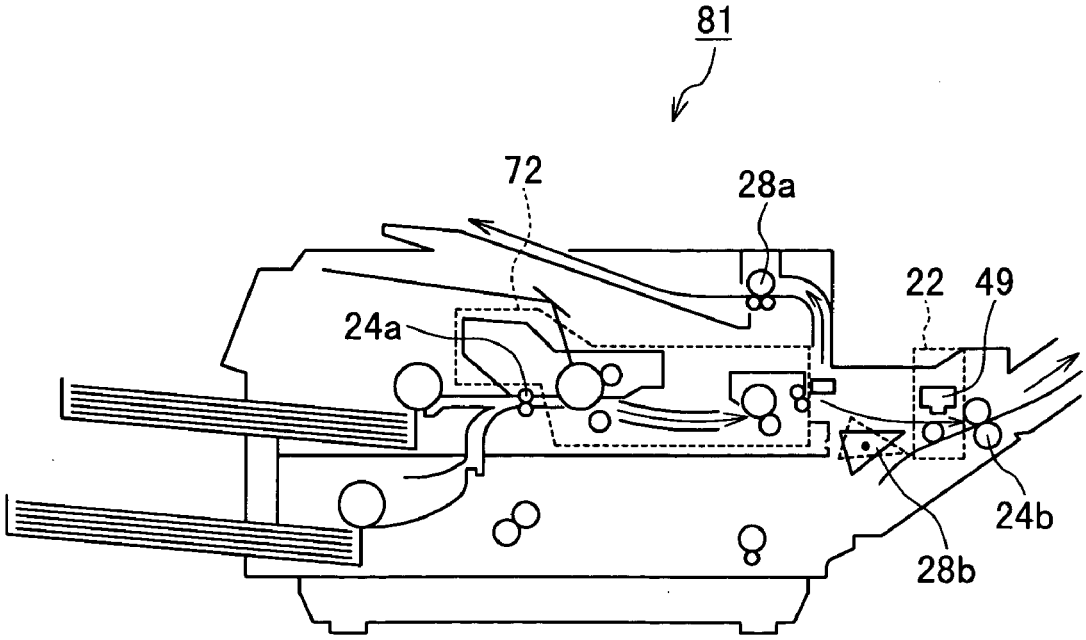
FIG. 23 is a side view of the image forming apparatus in the third embodiment.

The media turnover unit 28 will now be described with reference to FIG. 23. After the electrophotographic printing unit 72 prints on one side of the printing medium 23, the printing medium 23 is transported upward by the switchback roller 28*b* and reversing roller 28*a*, and stops while still held by the reversing roller 28*a*. The switchback roller 28*b* then changes orientation, and the reversing roller 28*a* rotates in the reverse direction, sending the printing medium 23 to the serial impact dot matrix printing unit 22.

Figure 24:
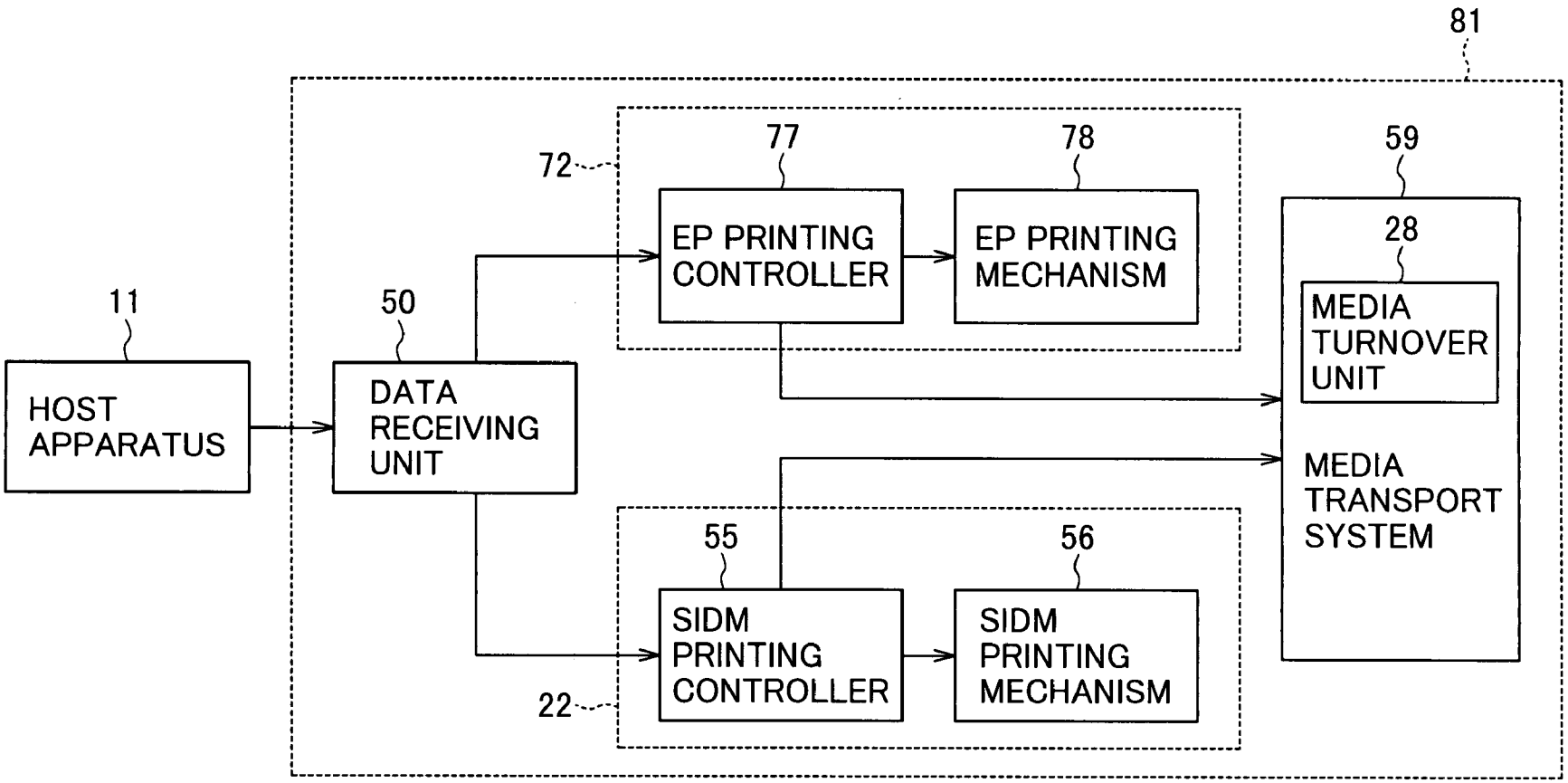
FIG. 24 is a block diagram schematically showing the structure of the image forming apparatus in the third embodiment.

The image forming apparatus 81 in the third embodiment will now be further described with reference to FIG. 24. This drawing shows that the electrophotographic printing unit 72 comprises an electrophotographic printing controller 77 and electrophotographic printing mechanism 78, the serial impact dot matrix printing unit 22 comprises a serial impact dot matrix printing controller 55 and serial impact dot matrix printing mechanism 56, and the media transport system 59 comprises the media turnover unit 28. The image forming apparatus 81 further comprises a data receiving unit 50.

The host apparatus 11 creates print data DATA1 and DATA2 as specified by the operator, and sends the print data to the image forming apparatus 81. The print data include instructions for printing an image in a certain position on the printing medium 23 by means of the electrophotographic printing unit 72 or serial impact dot matrix printing unit 22. The print data have the same structure as in the first embodiment.

The data receiving unit 50 receives the print data sent from the host apparatus 11, distinguishes DATA1 from DATA2 by the printing unit selection information, sends DATA1 to the electrophotographic printing controller 77, and sends DATA2 to the serial impact dot matrix printing controller 55. If the print data sent from the host apparatus 11 do not include printing unit selection information, the print data are sent to the electrophotographic printing controller 77. The printing algorithm in the third embodiment is the same as in the first embodiment.

The electrophotographic printing mechanism 78 and media transport system 59 operate as specified by the position information and image information sent to the electrophotographic printing controller 77 in DATA1. The serial impact dot matrix printing mechanism 56 and media transport system 59 operate as specified by the position information and image information sent to the serial impact dot matrix printing controller 55 in DATA2. If double-sided printing is carried out, after the electrophotographic printing unit 72 has printed on one side of the printing medium 23, the printing medium 23 is turned over by the media turnover unit 28 so that the impact mechanism of the serial impact dot matrix printing mechanism 56 strikes the reverse side of the printing medium 23.

Figure 25A:
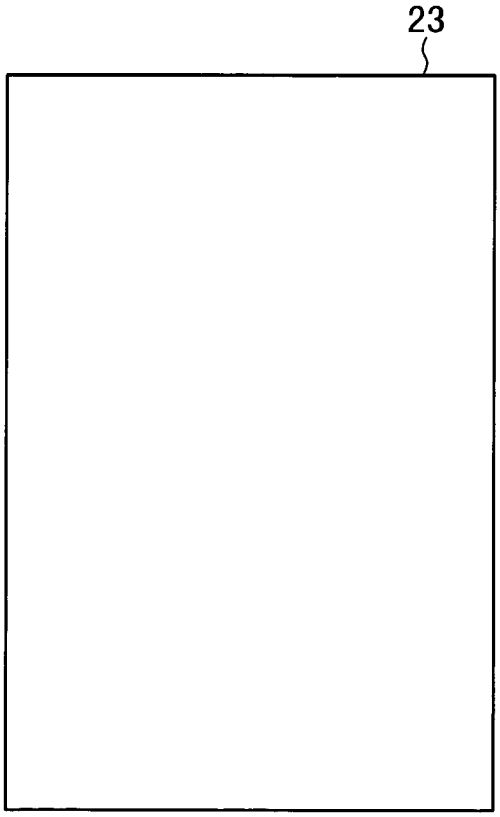
FIGS. 25A and 25B show media before and after printing in the third embodiment.
Figure 25B:
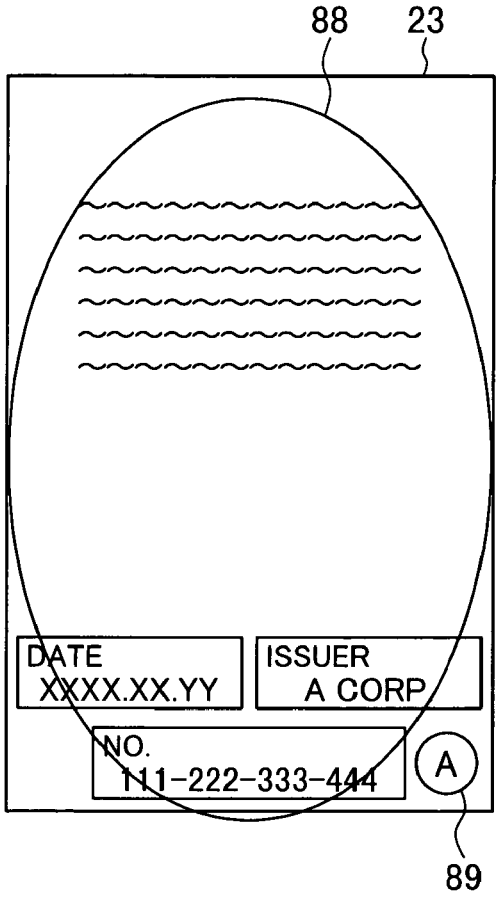
Figure 26:
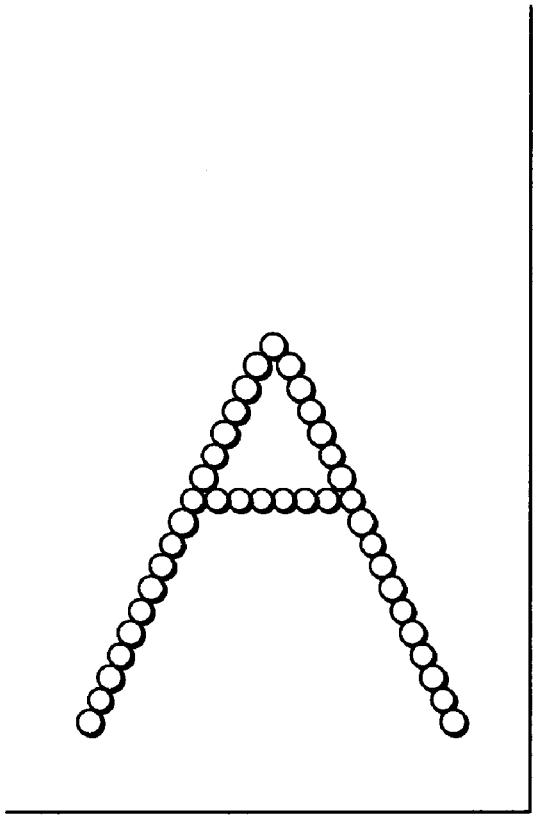
FIG. 26 is an enlarged view of the identifying information in the third embodiment.
Figure 27:
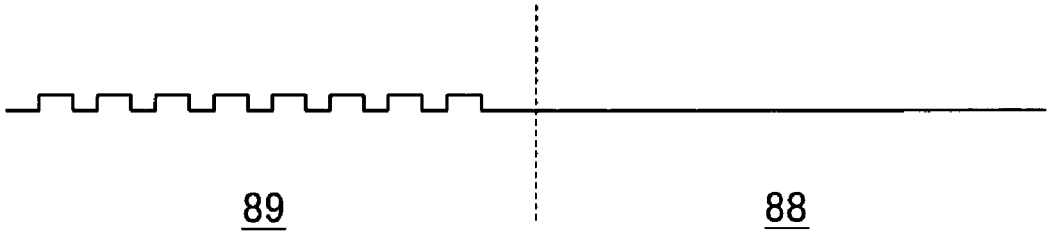
FIG. 27 is a side view of the printed media in the third embodiment.

An exemplary page printed by the third embodiment will now be described. The printing media 23 used in this embodiment are cut sheets of plain white paper, as shown in FIG. 25A. Each sheet has two printed areas 88 and 89, as shown in FIG. 25B. The document text, issuer, date of issuance, serial number, and so on are printed in the first area 88 by the electrophotographic printing unit 72, and identifying information is printed in the second area 89 by the serial impact dot matrix printing unit 22. FIG. 26 is an enlarged view of the identifying information. The image printed in the second area 89 by the serial impact dot matrix printing unit 22 is not printed with ink but is only embossed, as shown in FIG. 27, by striking from the reverse side.

Figure 28:
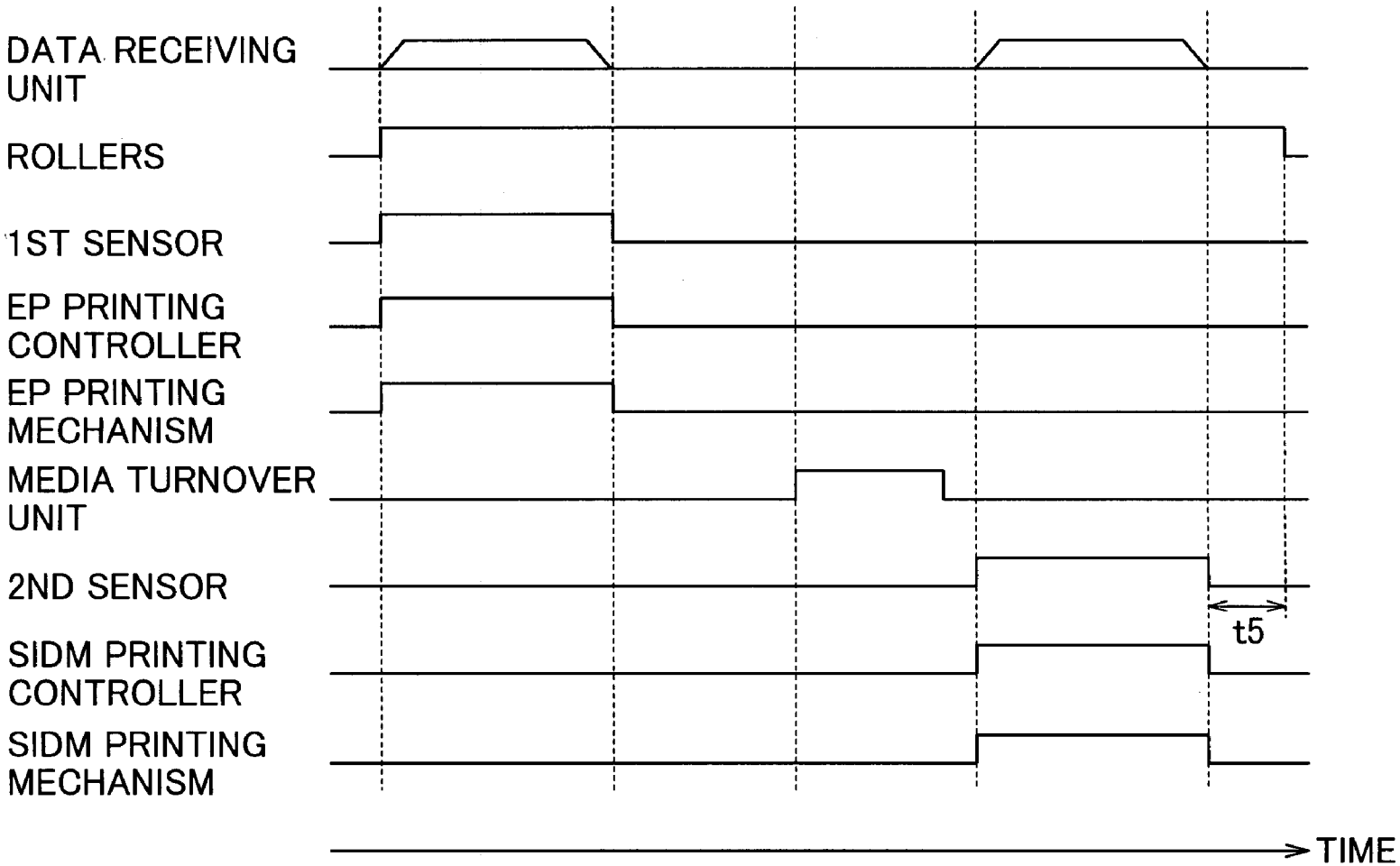
FIG. 28 is a timing diagram illustrating the operation of different components of the image forming apparatus in the third embodiment.
Figure 29:
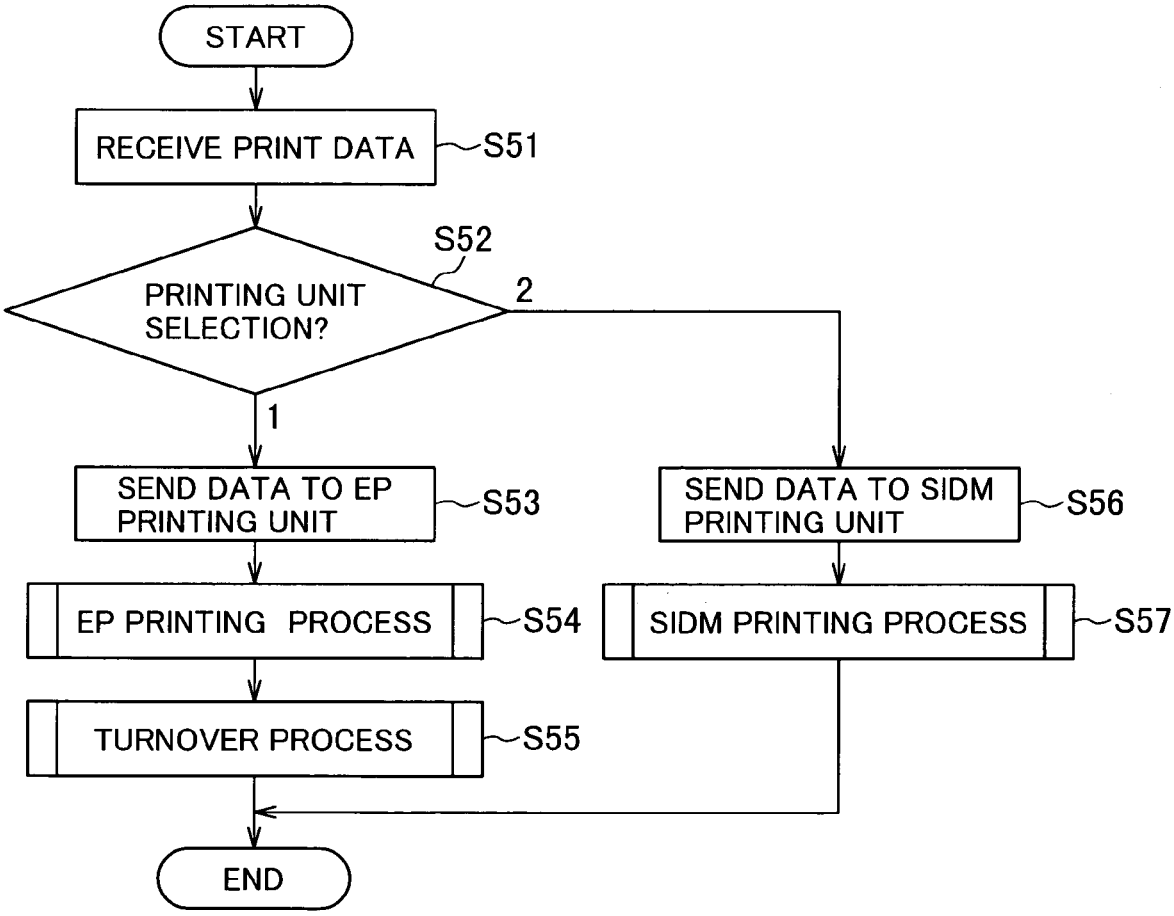
FIG. 29 is a flowchart illustrating the operation of the image forming apparatus in the third embodiment.
Figure 30:
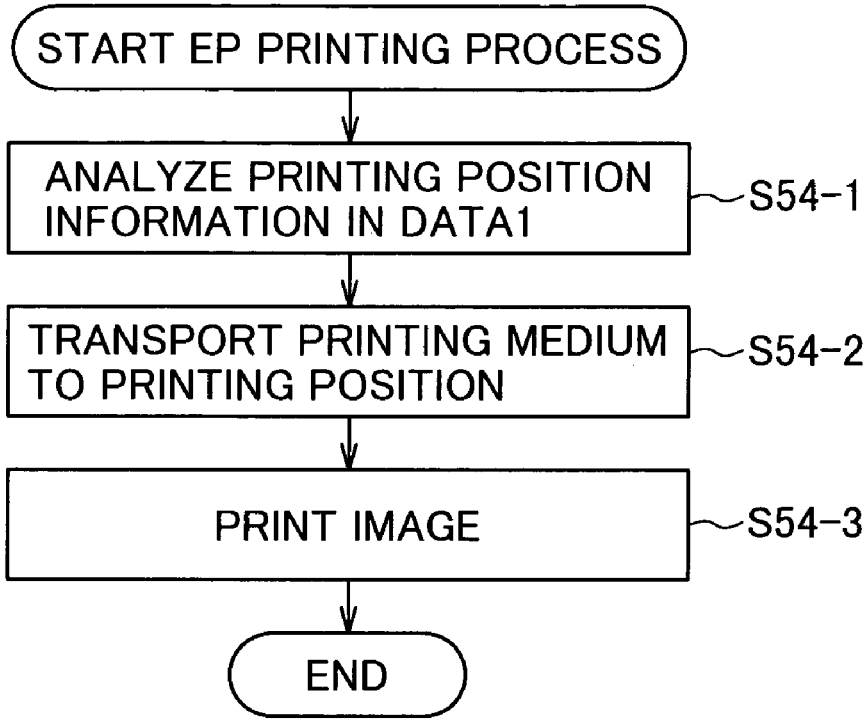
FIG. 30 is a flowchart illustrating the subroutine that carries out step S54 in FIG. 29.
Figure 31:
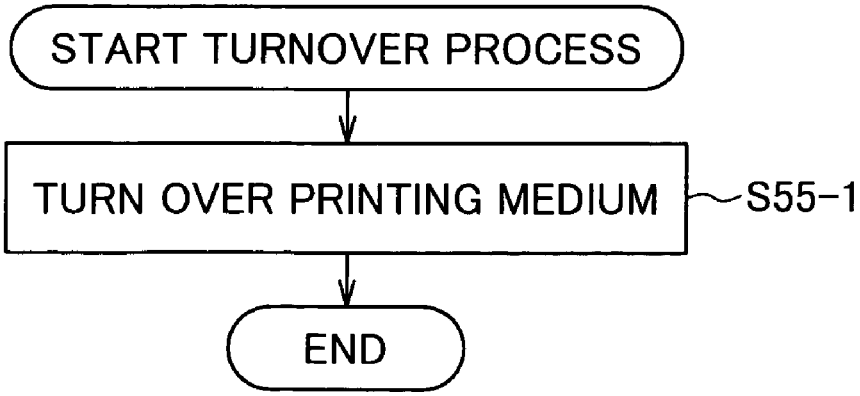
FIG. 31 is a flowchart illustrating the subroutine that carries out step S55 in FIG. 29.
Figure 32:
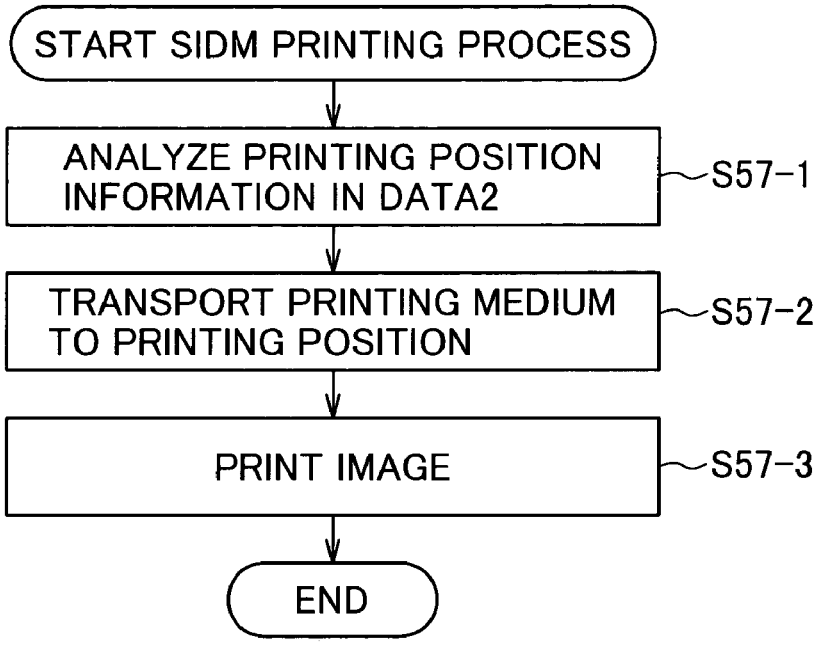
FIG. 32 is a flowchart illustrating the subroutine that carries out step S57 in FIG. 29.

The operation of the image forming apparatus 81 in the third embodiment will now be described with reference to FIGS. 28 to 32. FIG. 28 is a timing diagram illustrating the operation of different components of the image forming apparatus in the third embodiment. FIG. 29 is a flowchart illustrating the operation of the image forming apparatus in the third embodiment. FIGS. 30, 31, and 32 are flowcharts illustrating subroutines included in the operation illustrated in FIG. 29.

In step S51 (FIG. 29), the data receiving unit 50 receives the print data sent from the host apparatus 11.

In step S52, the data receiving unit 50 reads the printing unit selection information included in the print data. If the printing unit selection information is set to '1', the data receiving unit 50 identifies the print data as DATA1, intended for the electrophotographic printing unit 72, and the processing proceeds to step S53. If the printing unit selection information is set to '2', the data receiving unit 50 identifies the print data as DATA2, intended for the serial impact dot matrix printing unit 22, and the processing proceeds to step S56.

In step S53, the data receiving unit 50 sends DATA1 to the electrophotographic printing unit 72.

In step S54, the electrophotographic printing unit 72 receives and processes DATA1 and prints the resulting image information.

In step S55, the printing medium 23 is transported into the media turnover unit 28 and turned over if necessary. If the printing medium 23 does not have to be turned over, it may be ejected from the turnover unit 28 as indicated by the uppermost arrow in FIG. 23, or fed to the serial impact dot matrix printing unit 22.

In step S56, the data receiving unit 50 sends DATA2 to the serial impact dot matrix printing unit 22.

In step S57, the serial impact dot matrix printing unit 22 receives and processes DATA2 and prints the resulting image information.

The process in FIG. 29 is repeated until all data for the current page have been received and printed. When the image forming apparatus 81 receives both DATA1 and DATA2, steps S53 to S55 are carried out in the first repetition and steps S56 and S57 in the second repetition. In this case, ejection of the printing medium 23 is completed after the elapse of time t5 in FIG. 28 from the completion of the printing by the serial impact dot matrix printing unit 22.

The flowchart in FIG. 30 illustrates the subroutine that carries out step S54.

In step S54-1, the electrophotographic printing unit 72 analyzes the printing position information in DATA1.

In step S54-2, the media transport system 59 transports the printing medium 23 to the printing position.

In step S54-3, the electrophotographic printing mechanism 78 prints the image described by DATA1; then the processing ends.

The flowchart in FIG. 31 illustrates the subroutine that carries out step S55.

In step S55-1, the printing medium 23 is transported to the media turnover unit 28 and turned over; then the processing ends.

The flowchart in FIG. 32 illustrates the subroutine that carries out step S57.

In step S57-1, the serial impact dot matrix printing controller 55 analyzes the printing position information in DATA2.

In step S57-2, the media transport system 59 transports the printing medium 23 to the printing position.

In step S57-3, the serial impact dot matrix printing mechanism 56 prints the image described by DATA2; then the processing ends.

Since the identifying information printed by the serial impact dot matrix printing unit 22 in this embodiment is only embossed, it is only faintly visible but is readily distinguishable by touch. If a copy is made by a copying machine, the original can be distinguished from the copy by touching the identifying information.

A fourth embodiment of the present invention will now be described, omitting detailed descriptions of aspects of the structure, operation, and effects that are the same as in any of the first to third embodiments.

The image forming units of the image forming apparatus in the fourth embodiment have the same general arrangement as in the second embodiment, shown in FIG. 13. The electrophotographic printing unit 72 provided as a first image forming unit has the same structure as in the second embodiment. The serial impact dot matrix printing unit 22 provided as a second image forming unit has substantially the same structure as in the first embodiment, but does not have an inked ribbon. The operation of rollers 24*a*, 24*b*, 27*a*, 27*b* and the overall operation and structure of the image forming apparatus 71 are the same as in the second embodiment.

Figure 33:
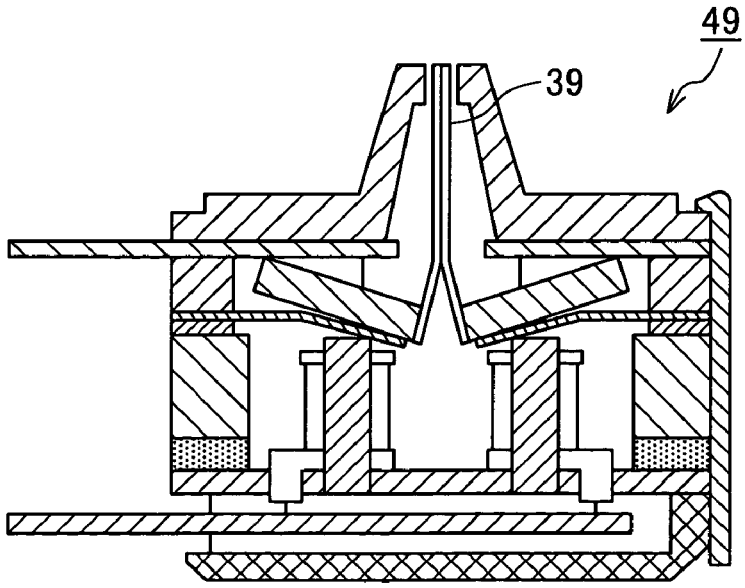
FIG. 33 is a sectional view of the printing head of the serial impact dot matrix printing unit in a fourth embodiment.
Figure 34A:
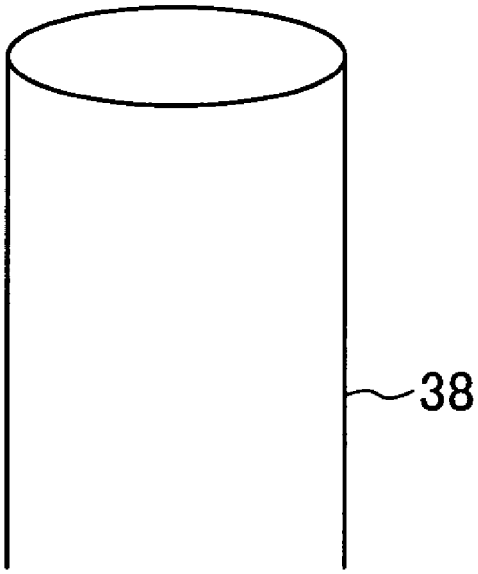
FIG. 34A shows the tips of the needle pins used in the print heads of the serial impact dot matrix printing units in the first, second, and third embodiments.
Figure 34B:
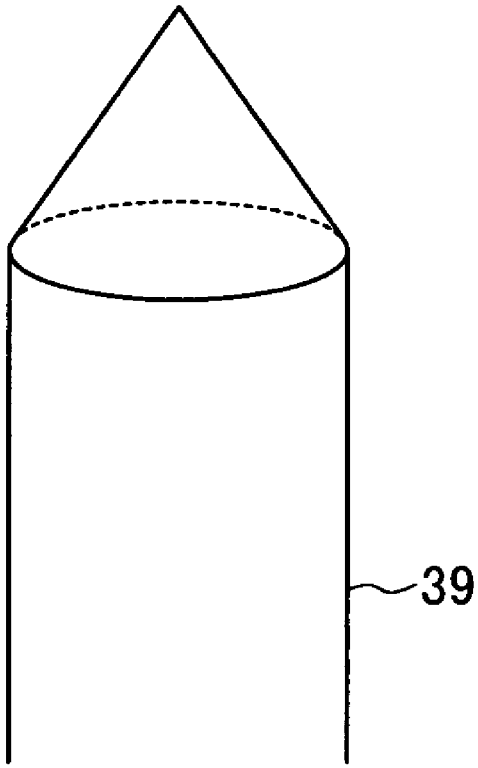
FIG. 34B shows the tips of the needle pins used in the print head of the serial impact dot matrix printing unit in the fourth embodiment.

The structure of the printing head 49 of the serial impact dot matrix printing unit 22 will now be described. The printing head 49 has needle pins 39, as shown in FIG. 33, that move longitudinally to strike the printing medium 23. While the needle pins 39 of the printing head 49 of the serial impact dot matrix printing unit 22 in the first to third embodiments have flat tips as shown in FIG. 34A, the needle pins 39 in the fourth embodiment have sharply pointed tips as shown in FIG. 34B. The needle pins 39 of the serial impact dot matrix printing unit 22 in the fourth embodiment punch holes in the printing medium 23.

Figure 35A:
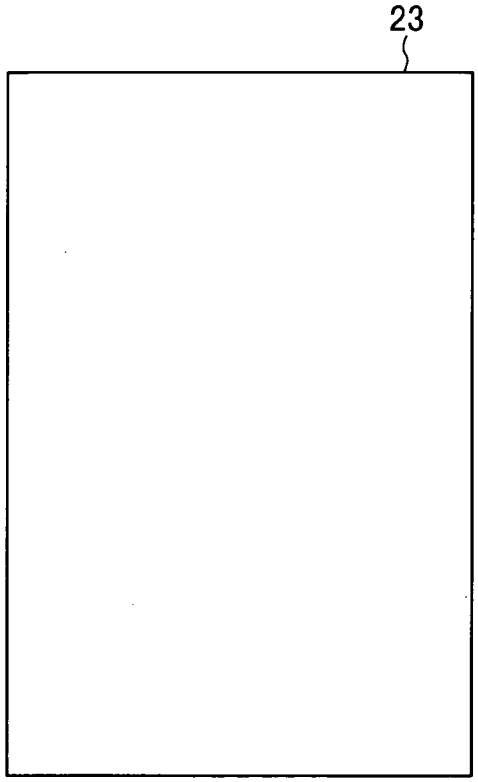
FIGS. 35A, 35B, and 35C show unprinted, printed, and copied media in the fourth embodiment.
Figure 35B:
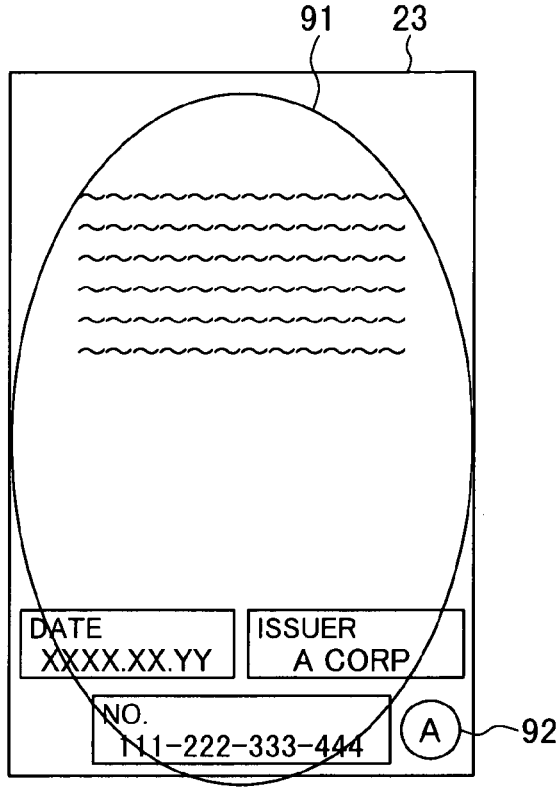

An exemplary page printed by the fourth embodiment will now be described. The printing media 23 used in this embodiment are cut sheets of plain white paper, as shown in FIG. 35A. Each sheet has two printed areas 91 and 92, as shown in FIG. 35B. The document text, date of issuance, issuer, a serial number, and so on are printed by the electrophotographic printing unit 72 in the first area 91. The identifying information in the second area 92 is printed by the serial impact dot matrix printing unit 22.

Figure 35C:
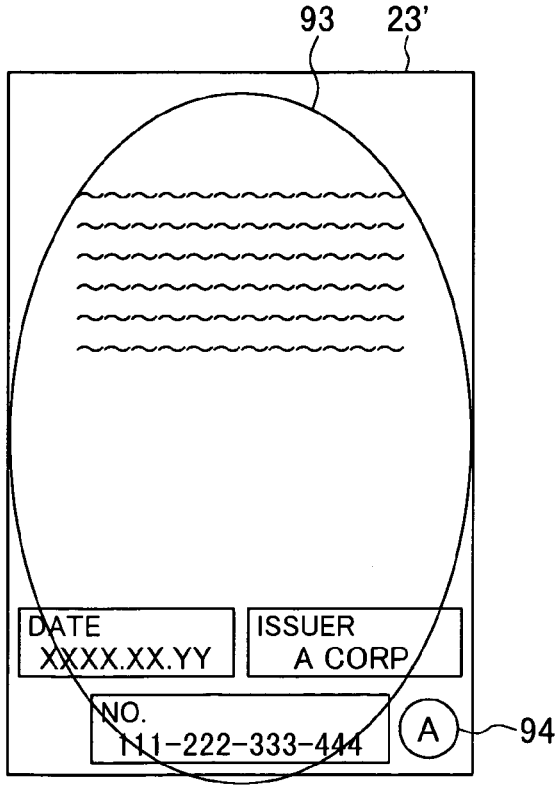

If the printed printing medium 23 is copied by a copying machine, the copy has two printed areas 93 and 94, as shown in FIG. 35C. At a glance, the original printed image on the printing medium 23 shown in FIG. 35B and the copy printed on the printing medium 23' shown in FIG. 35C may seem to be the same.

Figure 36A:
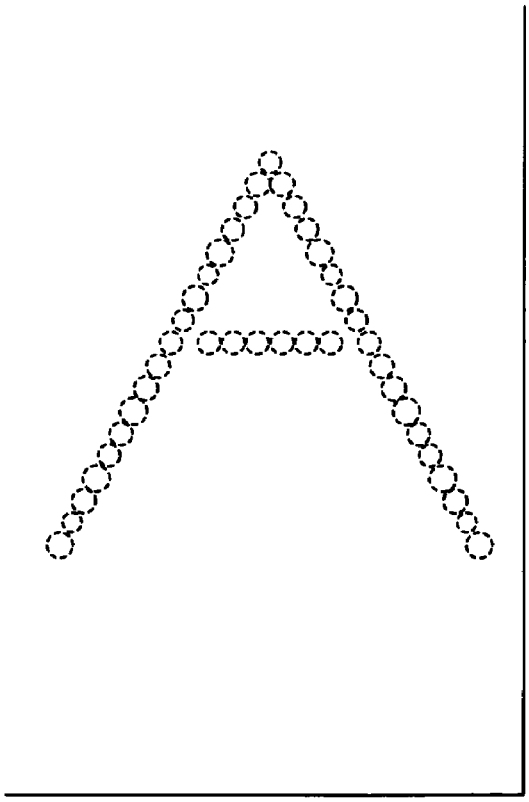
FIGS. 36A and 36B are enlarged views showing the difference between the original in FIG. 35B and the copy in FIG. 35C.
Figure 36B:
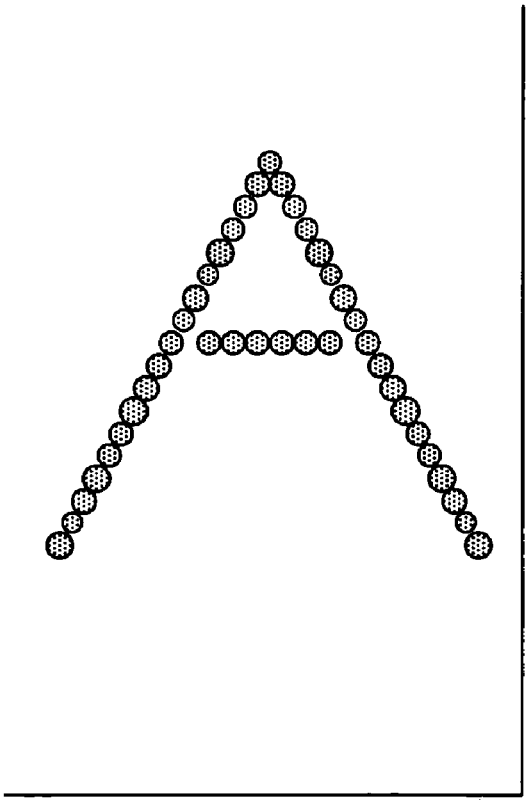

Close observation of the media, however, shows a difference between the original and the copy. The identifying image produced in the second area 92 on the original by the serial impact dot matrix printing unit 22 comprises punched holes, as shown in FIG. 36A. The copy of the identifying image in the second area 94 is not punched but is printed in a faint shade of gray, as shown in FIG. 36B.

Therefore, in the fourth embodiment, the printing medium 23 on which the original image was printed can be easily distinguished from the printing medium 23' on which the copy was printed by checking whether the identifying information is printed as a pattern of small punched holes. The problems associated with unidentified copies can accordingly be avoided.

A fifth embodiment of the present invention will now be described, omitting detailed descriptions of aspects of the structure, operation, and effects that are the same as in any of the first to fourth embodiments.

The image forming units of the image forming apparatus in the fifth embodiment have the same arrangement as in the second embodiment, shown in FIG. 13. The operation and structure of the image forming apparatus 71, including the structure of the electrophotographic printing unit 72 provided as a first image forming unit, the structure of the serial impact dot matrix printing unit 22 provided as a second image forming unit, and the operation of rollers 24*a*, 24*b*, 27*a*, 27*b* are the same as in the second embodiment. The fifth embodiment addresses the problem of distinguishing an original document printed by the image forming apparatus from copies that may be either printed by the same image forming apparatus or made with a copying machine.

Figure 37A:
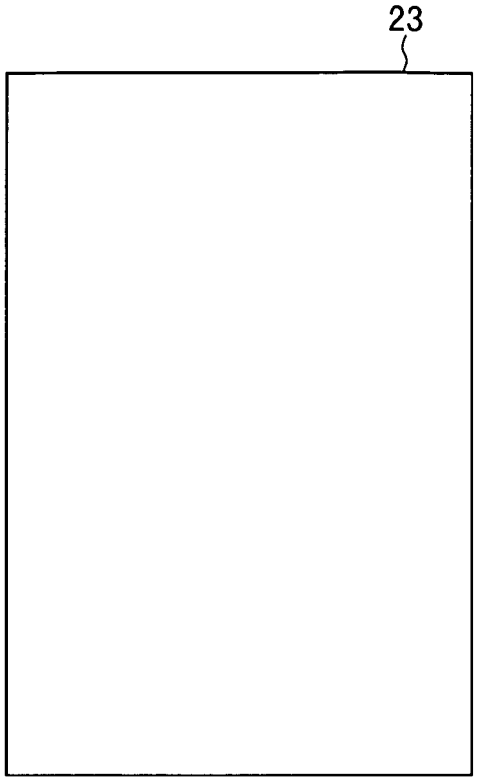
FIGS. 37A, 37B, and 37C show unprinted, printed, and copied media in a fifth embodiment.
Figure 37B:
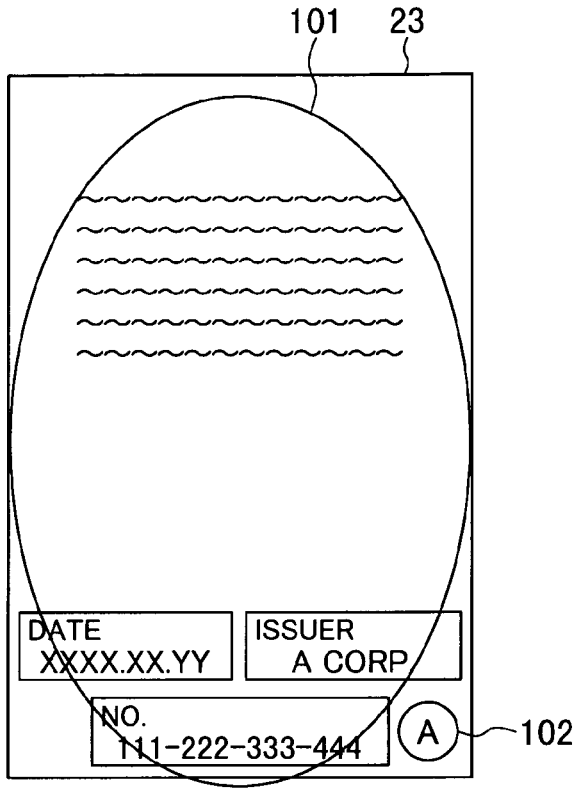

An exemplary page printed by the fifth embodiment will now be described. The printing media 23 used in this embodiment are cut sheets of plain white paper, as shown in FIG. 37A. Each sheet has two printed areas 101 and 102, as shown in FIG. 37B. The document text, date of issuance, issuer, a serial number, and so on are printed by the electrophotographic printing unit 72 in the first area 101. In the original printout, the identifying information in the second area 102 is printed by both the serial impact dot matrix printing unit 22 and the electrophotographic printing unit 72. If further copies are printed by the same image forming apparatus, the identifying information is printed only by the electrophotographic printing unit 72.

Figure 37C:
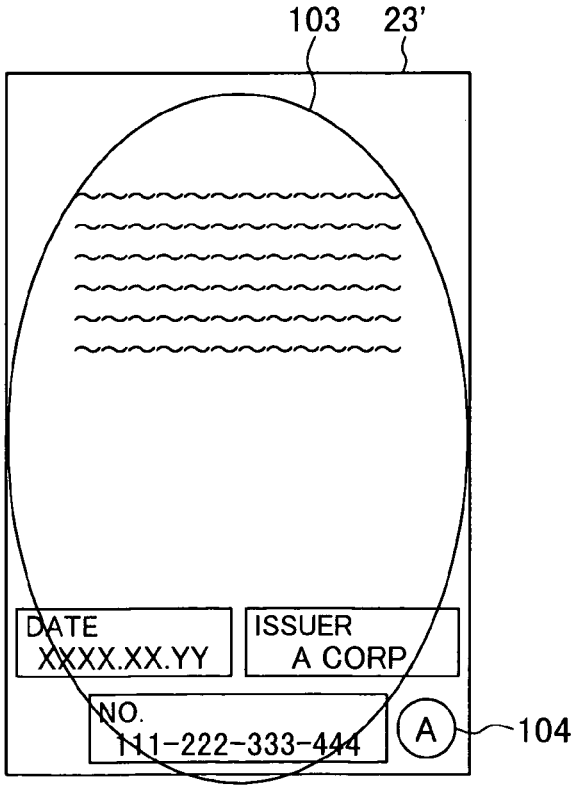

A copy printed by the electrophotographic printing unit 72 has two printed areas 103 and 104 as shown in FIG. 37C. At a glance, the original printed image on the printing medium 23 shown in FIG. 37B and the further copy printed on the further printing medium 23' as shown in FIG. 37C seem to be the same.

Figure 38A:
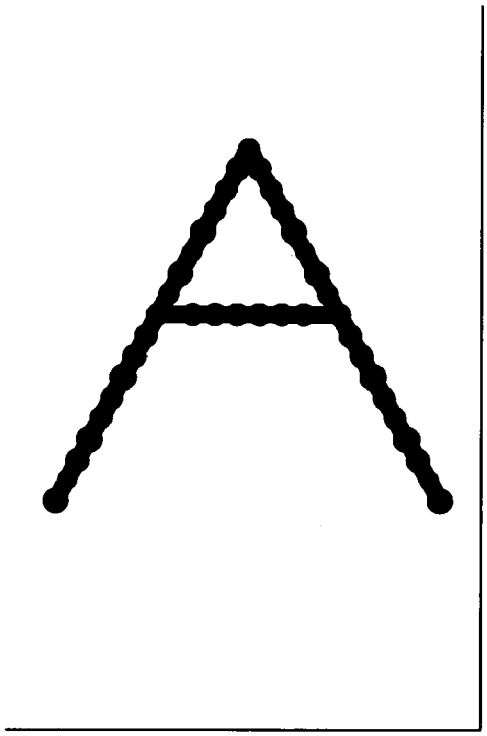
FIGS. 38A and 38B are enlarged views showing the difference between the original in FIG. 37B and the copy in FIG. 37C.
Figure 38B:
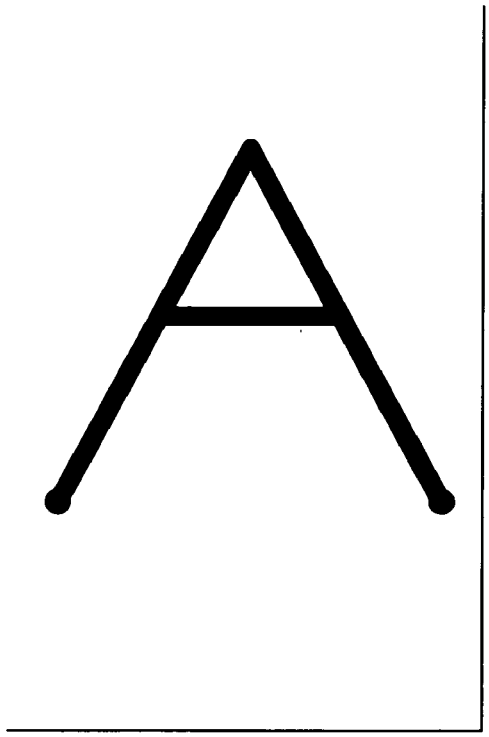

A close observation of the media, however, shows a difference between the original and the copy. The identifying image produced in the second area 102 on the original printing medium 23 is an embossed ink-and-toner image, as shown in FIG. 38A. The copy of the identifying image in the second area 104 on the copy is not embossed or printed with ink, but is printed only as a toner image, as shown in FIG. 38B.

The printing medium 23 on which the original image was printed can be distinguished from printing media 23' on which copies are printed because the identifying image on the original is printed by both the electrophotographic printing unit 72 and serial impact dot matrix printing unit 22, which use different printing mechanisms. A person knowing how to tell the difference can readily identify a printed document as the original or a copy, by touching the identifying information to ascertain whether it is embossed, for example. Copies made with a copying machine are distinguishable in the same way. The difference between the original and a copy can easily be overlooked, however, by a person not knowing that any difference exists. Thus the difference between the original and a copy can be made apparent to intended persons, without making the difference obvious to unintended persons. A high level of document security can accordingly be provided.

The fifth embodiment is particularly useful when the identifying information is information such as a corporate seal. The serial impact dot matrix printing unit 22 provides document security by printing and embossing the identifying information on the original document, while the electrophotographic printing unit 72 ensures that the identifying information is printed with high quality on both the original document and copies thereof, including copies that may be made subsequently with a copying machine.

A sixth embodiment of the present invention will now be described, omitting detailed descriptions of aspects of the structure, operation, and effects that are the same as in any of the first to fifth embodiments.

Figure 39:
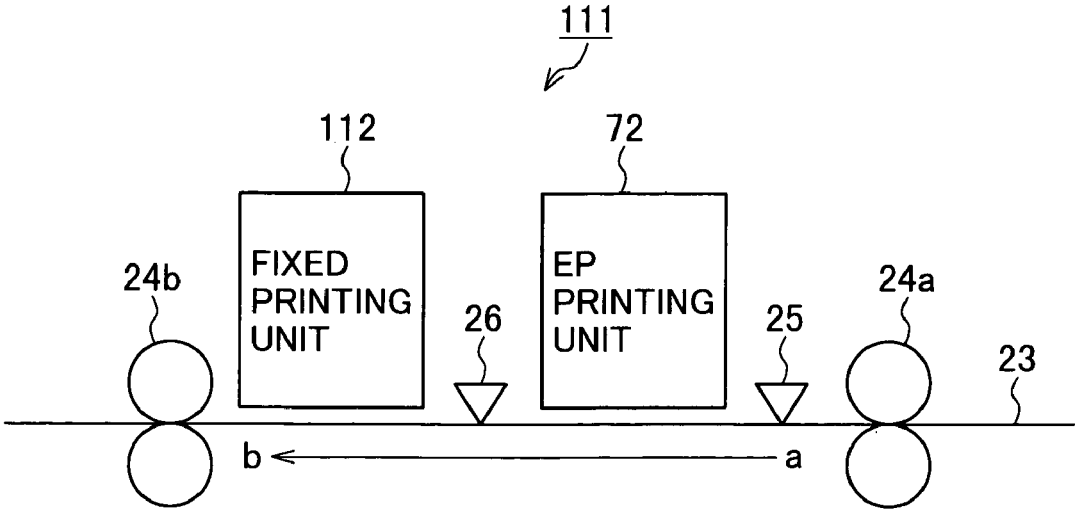
FIG. 39 shows the general arrangement of the image forming part of the image forming apparatus in a sixth embodiment.

Referring to FIG. 39, the image forming apparatus 111 comprises an electrophotographic printing unit 72, which is provided as a first image forming unit, a fixed printing unit 112, which is provided as a second image forming unit, a pair of rollers 24*a*, 24*b*, and a pair of sensors 25, 26. The electrophotographic printing unit 72 has the same structure as in the second embodiment.

The sensors 25, 26 detect the position of the printing medium 23. The rollers 24*a* and 24*b* transport the printing medium 23 on the basis of the positions detected by the sensors 25, 26, in the direction shown by the arrow from 'a' to 'b'. When the printing medium 23 reaches an appropriate position, the electrophotographic printing unit 72 prints an image on the printing medium 23 according to data (DATA1) received from the host apparatus 11. When the printing medium 23 reaches a further appropriate position, the fixed printing unit 112 makes a fixed mark on the printing medium 23. Both the image printed according to DATA1 and the mark printed by the fixed printing unit 112 can be printed on the same page.

Figure 40A:
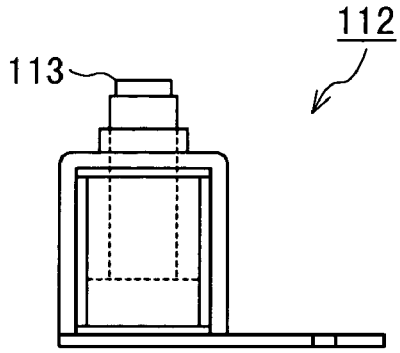
FIG. 40A is a side view of the fixed printing unit in the sixth embodiment.
Figure 40B:
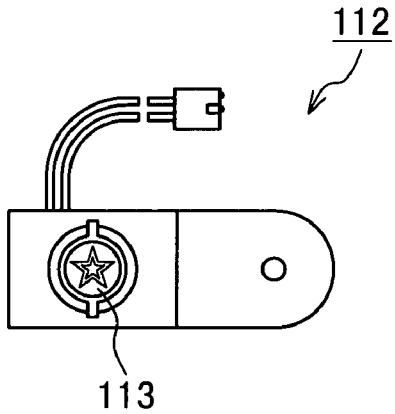
FIG. 40B is a top view of the fixed printing unit in the sixth embodiment.
Figure 40C:
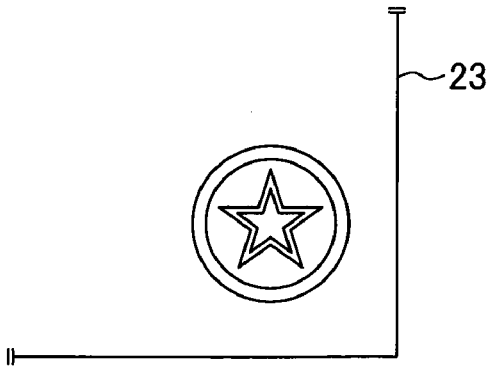
FIG. 40C shows a fixed mark printed by the fixed printing unit in the sixth embodiment.

The fixed printing unit 112 in the sixth embodiment will now be further described. Referring to FIGS. 40A and 40B, the fixed printing unit 112 is a type of stamping unit comprising a plunger with a stamp 113 at its exposed end. The fixed printing unit 112 may also comprise an inked ribbon or other means enabling the stamp 113 to print an inked image on the printing medium 23. Alternatively, the stamp 113 may only form an embossed image. FIG. 40C shows an example of a fixed mark that may be formed by the fixed printing unit 112.

Figure 41:
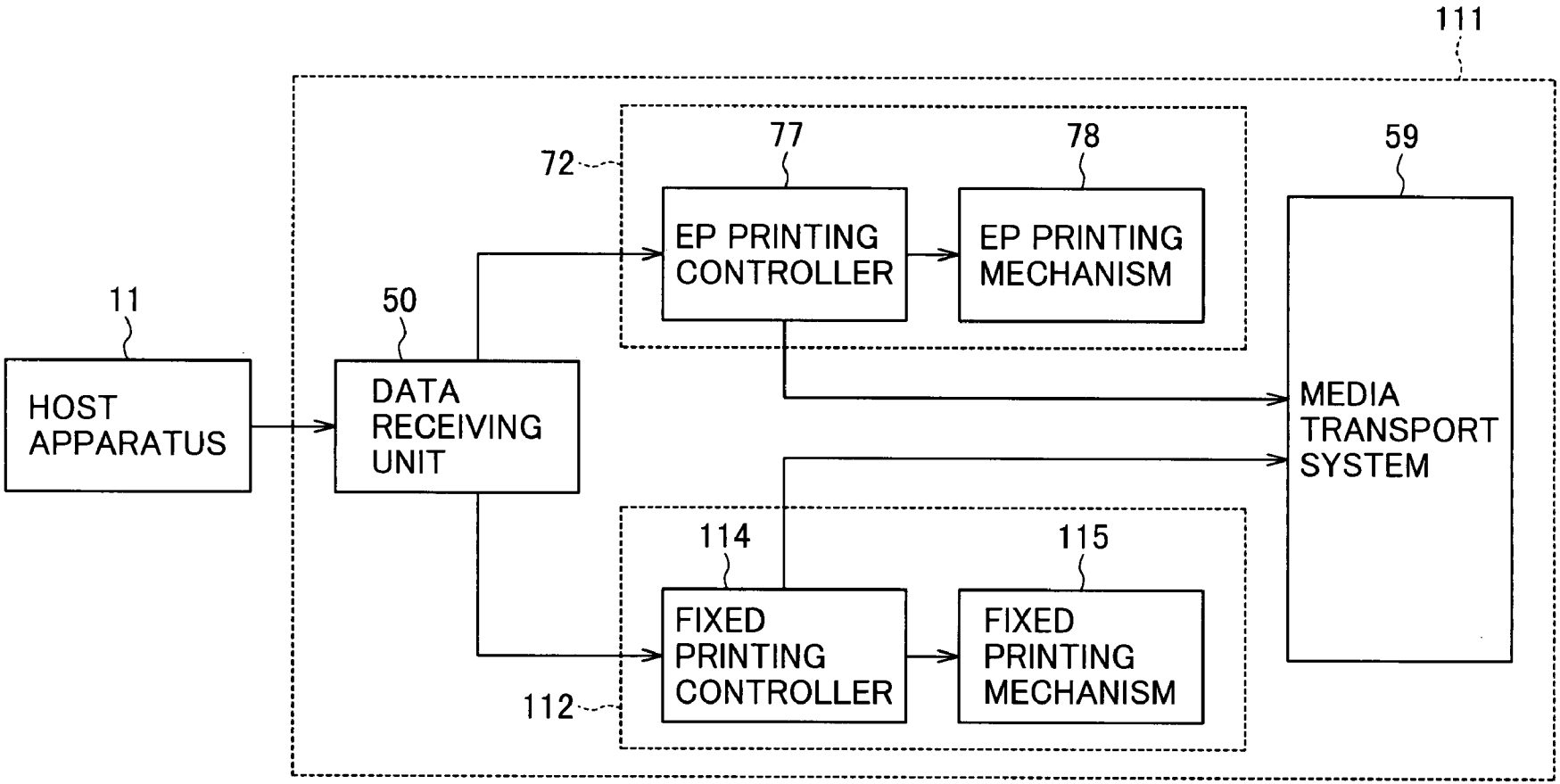
FIG. 41 is a block diagram schematically showing the structure of the image forming apparatus in the sixth embodiment.

The structure of the image forming apparatus in the sixth embodiment will be described with reference to FIG. 41. This drawing shows that the electrophotographic printing unit 72 comprises an electrophotographic printing controller 77 and an electrophotographic printing mechanism 78, and the fixed printing unit 112 comprises a fixed printing controller 114 and a fixed printing mechanism 115. The image forming apparatus 111 also comprises a data receiving unit 50 and a media transport system 59.

The host apparatus 11 creates print data as specified by the operator, and sends the print data to the image forming apparatus 111. The print data include instructions for printing an image in a certain position on the printing medium 23 by means of the electrophotographic printing unit 72, and may also include instructions for the fixed printing unit 112. The print data have the same structure as in the first embodiment.

The data receiving unit 50 receives the print data sent from the host apparatus 11, distinguishes print data intended for the electrophotographic printing unit 72 from fixed printing instructions intended for the fixed printing unit by reading the printing unit selection information, sends print data to the electrophotographic printing controller 77, and sends fixed printing instructions to the fixed printing controller 114.

The electrophotographic printing mechanism 78 and media transport system 59 operate as specified in the print data sent to the electrophotographic printing controller 77, and an image is printed accordingly on the printing medium 23. Then the fixed printing mechanism 115 and media transport system 59 operate to print a mark on the printing medium 23 if so specified by the instruction data sent to the fixed printing controller 114.

Figure 42A:
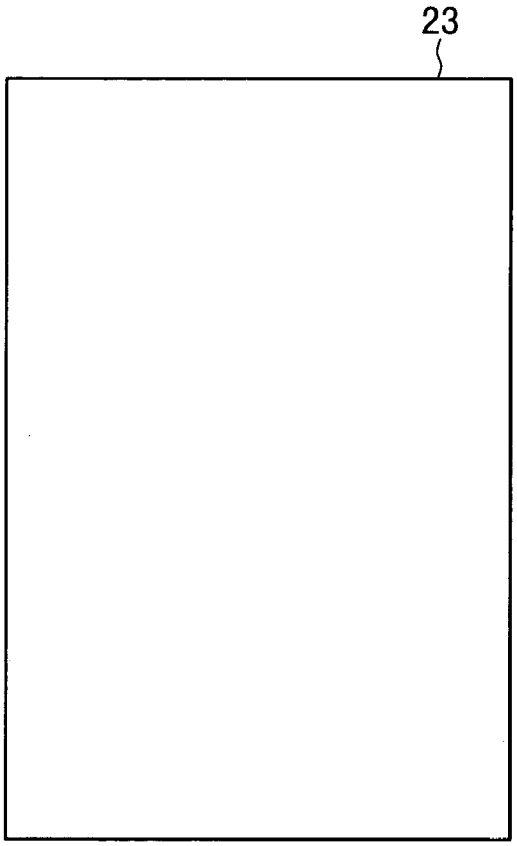
FIGS. 42A and 42B show media before and after printing in the sixth embodiment.
Figure 42B:
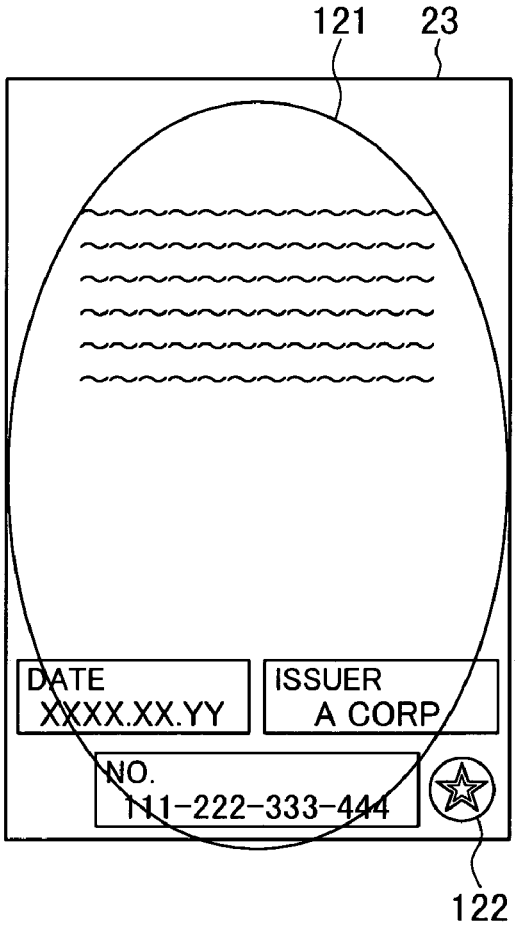

An exemplary page printed by the sixth embodiment will now be described. The printing media 23 used in this embodiment are cut sheets of plain white paper, as shown in FIG. 42A. Each sheet has two printed areas 121 and 122, as shown in FIG. 42B. The document text, date of issuance, issuer, a serial number, and so on are printed in the first area 121 by the electrophotographic printing unit 72, and the fixed mark is printed in the second area 122 by the fixed printing unit 112.

Figure 43:
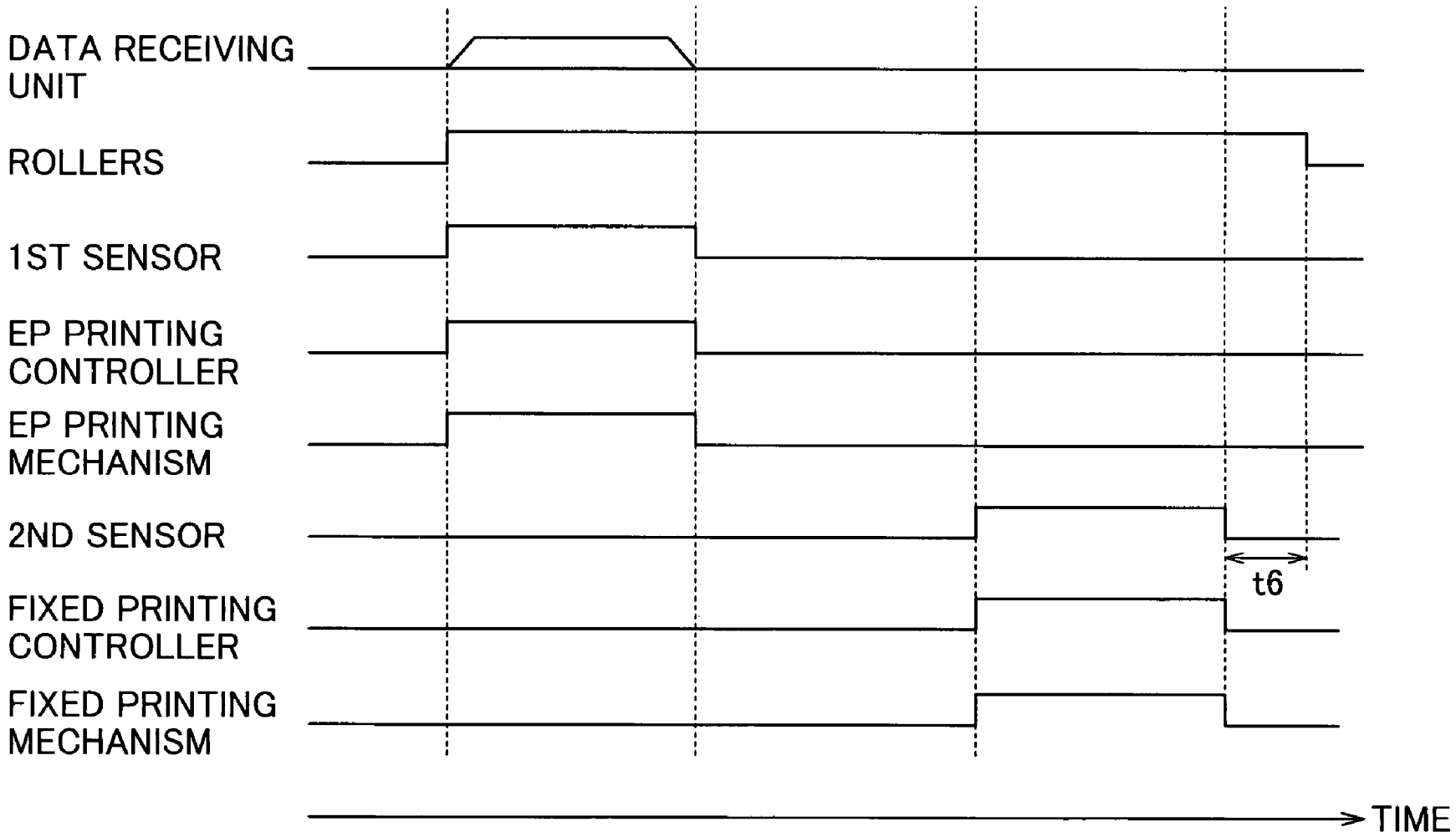
FIG. 43 is a timing diagram illustrating the operation of the image forming apparatus in the sixth embodiment.
Figure 44:
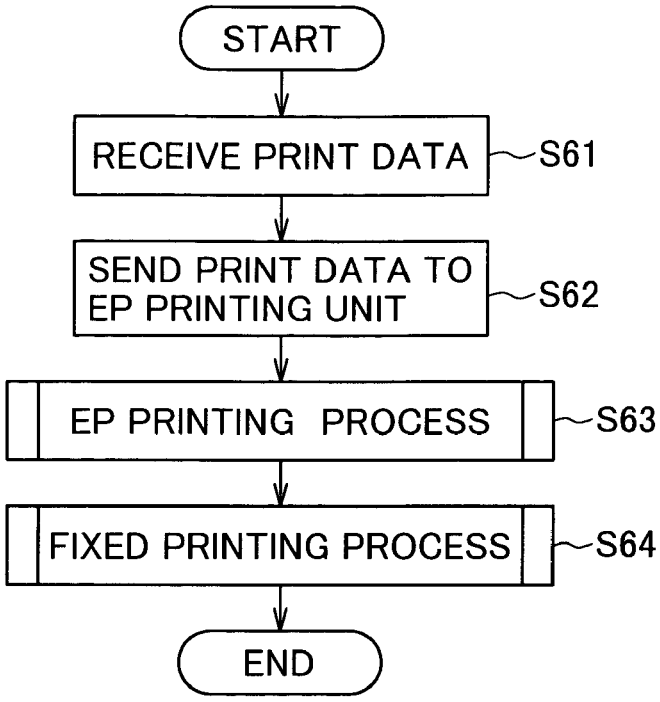
FIG. 44 is a flowchart illustrating the operation of the image forming apparatus in the sixth embodiment.
Figure 45:
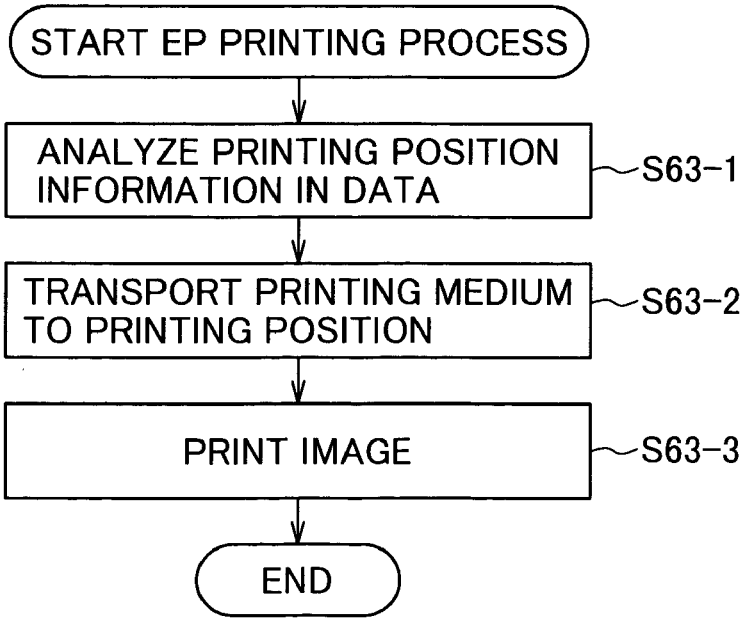
FIG. 45 is a flowchart illustrating the subroutine that carries out step S63 in FIG. 44.
Figure 46:
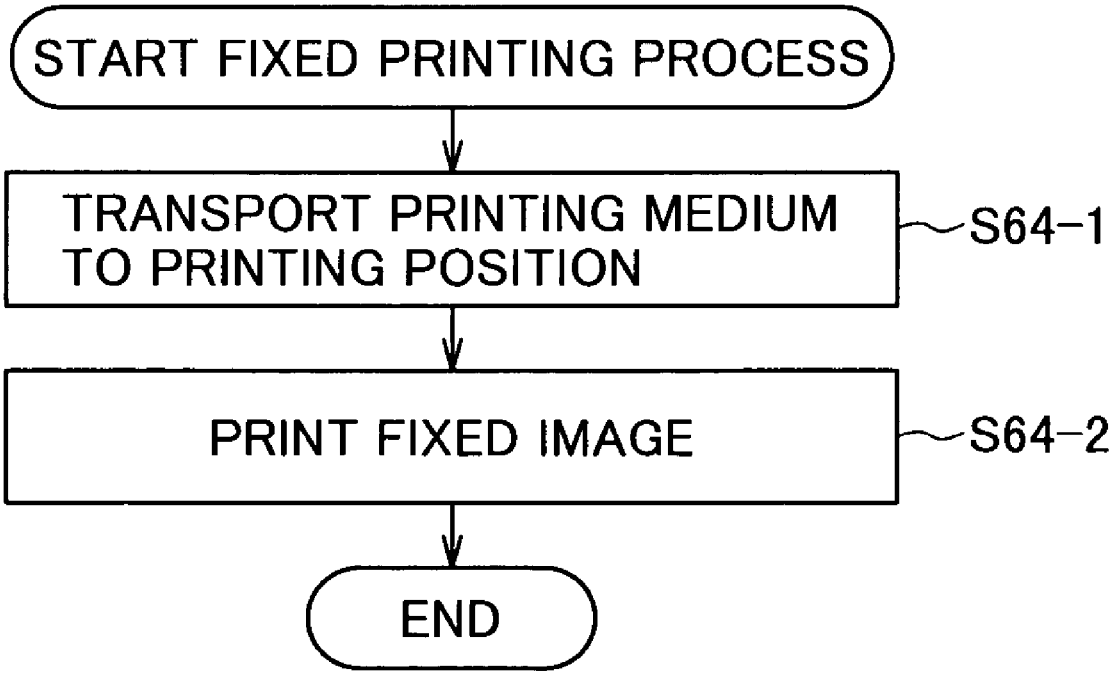
FIG. 46 is a flowchart illustrating the subroutine that carries out step S64 in FIG. 44.

The operation of the image forming apparatus 111 in the sixth embodiment will next be described with reference to the following drawings. FIG. 43 is a timing diagram illustrating the operation of the image forming apparatus. FIG. 44 is a flowchart illustrating the operation of the image forming apparatus. FIGS. 45 and 46 are flowcharts illustrating subroutines appearing in FIG. 44.

In step S61 (FIG. 44), the data receiving unit 50 receives the print data sent from the host apparatus 11.

In step S62, the data receiving unit 50 sends the print data to the electrophotographic printing unit 72.

In step S63, the electrophotographic printing unit 72 processes the print data and prints the image specified by the print data.

In step S64, the fixed printing unit 112 prints the fixed mark, if so specified, and the processing ends.

The flowchart in FIG. 45 illustrates the subroutine that carries out step S63 in the sixth embodiment.

In step S63-1, the electrophotographic printing unit 72 analyzes the position information in the print data.

In step S63-2, the media transport system 59 transports the printing medium 23 to the printing position.

In step S63-3, the electrophotographic printing controller 77 and electrophotographic printing mechanism 78 print the image specified by the print data.

The flowchart in FIG. 46 illustrates the subroutine that carries out step S64 in the sixth embodiment.

In step S64-1, the fixed printing controller 114 and media transport system 59 transport the printing medium 23 to the printing position.

In step S64-2, the fixed printing controller 114 and fixed printing mechanism 115 make the fixed mark on the printing medium 23.

Ejection of the printing medium 23 is completed after the elapse of time t6 in FIG. 43 from the completion of the printing of the fixed mark by the fixed printing unit 112.

The fixed mark can be used in various ways to distinguish the printing medium 23 on which the original image from copies thereof. For example, the fixed printing unit 112 may be adapted to make an embossed mark: in this case, the original will bear an embossed mark and copies made with a copying machine will only bear a printed mark. Alternatively, the fixed printing unit 112 may be adapted to make punched holes or other types of marks that cannot be faithfully reproduced by a copying machine. If copies are made by the image forming apparatus 111 itself, the fixed mark can be printed only on the original, and not on the copies.

A date seal or postmark may be printed as the fixed mark. If the fixed mark contains a date, the fixed printing mechanism 115 should have a dial or some other means with which the operator can manually set a desired date.

In a variation of the sixth embodiment, the fixed mark is printed by the serial impact dot matrix printing mechanism 56 used in the first to fifth embodiments, instead of the fixed printing mechanism 115. The fixed printing controller 114 may store the print data describing the fixed mark internally or may receive the print data from an external source such as a personal computer or a smart card. In this variation, accordingly, the fixed printing controller 114 may include a storage unit such as a nonvolatile memory for storing fixed print data, and may operate according to the fixed print data.

In a variation of any of the preceding embodiments, the first image forming unit is a thermal printing unit instead of an ink jet or electrophotographic printing unit.

Those skilled in the art will recognize that further variations are possible within the scope of the invention, which is defined in the appended claims.

What is claimed is:

1. An image forming apparatus including a first image forming unit with a first movable printing head that travels over a printing medium to form a first image and a second image forming unit with a second movable printing head that travels over the printing medium to form a second image, the first and second image forming units forming images by different methods on a single page of the printing medium, wherein the second image is an identifying image and the first image is at least partly different from the identifying image.

2. The image forming apparatus of claim 1, wherein the identifying image identifies an original image to distinguish the original image from copies thereof.

3. The image forming apparatus of claim 1, wherein the first image forming unit is an ink jet printing unit and the second image forming unit is an impact printing unit.

4. The image forming apparatus of claim 3, also including means for transporting the printing medium from the first image forming unit to the second image forming unit, the first image being formed before the second image.

5. The image forming apparatus of claim 3, also including a roller for feeding the printing medium toward the first image forming unit and the second image forming unit, wherein the first and second printing units position the first image and the second image according to rotation of the roller.

6. The image forming apparatus of claim 5, also including:

a first sensor disposed between the first printing unit and the roller, for sensing the printing medium; and a second sensor disposed between the first printing unit and the second printing unit, for sensing the printing medium; wherein the first printing unit positions the first image according to the rotation of the roller following sensing of the printing medium by the first sensor; and the second printing unit positions the second image according to the rotation of the roller following sensing of the printing medium by the second sensor.

7. The image forming apparatus of claim 3, wherein the first image overlaps the second image.

8. The image forming apparatus of claim 7, also including a data receiving unit for receiving print data with attached selection information and sending the print data to the first printing unit, the second printing unit, or the first and second printing units according to the selection information.

9. The image forming apparatus of claim 7, wherein at least one of the first image forming unit and the second image forming unit includes a mechanism that deforms the page.

10. The image forming apparatus of claim 9, wherein said mechanism is an impact mechanism for striking the page.

11. The image forming apparatus of claim 9, wherein the second printing unit embosses the printing medium.

12. An image forming apparatus comprising:

a first printing unit for transporting a printing medium and, while transporting the printing medium, forming a first image on the printing medium and fusing the first image onto the printing medium;

a second printing unit for forming a second image on the printing medium while the first printing unit is forming the first image, transport of a part of the printing medium on which the second image is formed being halted while the second image is being formed;

a slack forming unit disposed between the first printing unit and the second printing unit, for forming slack in the printing medium, the slack forming unit including a first roller that transports the printing medium and a second roller, disposed between the first roller and the second printing unit, that turns to reduce the slack and stops turning to increase the slack.

13. The image forming apparatus of claim 12, wherein one of the first image forming unit and the second image forming unit includes an impact mechanism for forming images on multiple-ply pressure-sensitive media.

14. The image forming apparatus of claim 12 wherein at least one of the first image and the second image differs in color from background parts of the page.

15. The image forming apparatus of claim 14, wherein the first image and the second image both differ in color from background parts of the page, the first image forming unit using a first coloring agent, the second image forming unit using a second coloring agent different from the first coloring agent.

16. The image forming apparatus of claim 15, wherein the first coloring agent is a toner agent and the second coloring agent is an ink agent.

17. The image fanning apparatus of claim 12, wherein the first image forming unit is an electrophotographic printing unit.

18. The image forming apparatus of claim 12, wherein the second image forming unit is a serial impact dot matrix printing unit.

19. The image forming apparatus of claim 12, wherein at least one of the first image forming unit and the second image forming unit includes a mechanism that deforms the page.

20. The image forming apparatus of claim 19, wherein said mechanism is an impact mechanism for striking the page.

21. The image forming apparatus of claim 20, wherein the first image forming unit and the second image forming unit form images on mutually reverse sides of the page.

22. The image forming apparatus of claim 20, wherein the page includes a first side and a second side, the first iniage forming unit forms an image on the first side of the page, the image formed by the first image forming unit differing in color from background parts of the first side of the page, and the second image forming unit forms an image on the first side of the page by striking the second side of the page.

23. The image forming apparatus of claim 19, wherein said mechanism is a punching mechanism for punching holes in the page.

24. The image forming apparatus of claim 19, wherein said mechanism is a punching mechanism for punching holes in the page.

* * * * *